US005716202A

United States Patent [19]

Koyama et al.

[11] Patent Number: 5,716,202

[45] Date of Patent: Feb. 10, 1998

[54] SCROLL COMPRESSOR WITH OILING MECHANISM

[75] Inventors: Masaki Koyama; Akihiko Yamamoto, both of Chiyoda-machi; Muneo Mizumoto; Eiichi Satoh, both of Tsuchiura; Shigekazu Nozawa, Shimizu; Kazutaka Suefuji, Shimizu; Kensaku Oguni, Shimizu; Youichi Murai, Chiyoda-machi; Tomoyuki Sato, Tsuchiura, all of Japan

[73] Assignee: Hitachi, Ltd., Tokyo, Japan

[21] Appl. No.: 527,943

[22] Filed: Sep. 14, 1995

[30] Foreign Application Priority Data

Sep. 20, 1994 [JP] Japan ..... 6-224764

[51] Int. Cl.[6] ..... F01C 1/04

[52] U.S. Cl. ..... 418/55.6; 418/56.3; 418/88; 418/89; 418/94

[58] Field of Search ..... 418/55.3, 55.6, 418/88, 89, 94, 151

[56] References Cited

U.S. PATENT DOCUMENTS

| | | | |
|---|---|---|---|
| 4,502,852 | 3/1985 | Hazaki | 418/94 |
| 4,621,993 | 11/1986 | Nakamura et al. | 418/55.6 |
| 4,780,061 | 10/1988 | Butterworth | 418/89 |
| 5,071,329 | 12/1991 | Sano et al. | 418/55.3 |

FOREIGN PATENT DOCUMENTS

| | | | |
|---|---|---|---|
| 9601 | 1/1981 | Japan | 418/55.6 |

*Primary Examiner*—Charles G. Freay

*Attorney, Agent, or Firm*—Antonelli, Terry, Stout, & Kraus, LLP

[57] ABSTRACT

An oil groove is provided in a space surrounded with the outer peripheral portion of an end plate of a revolving scroll, a stationary scroll and a frame on the inner surface of the frame, and lubricating oil attached to the inner surface of the frame by splashed with rotation of the balancing weight is reserved in the oil groove and then supplied to a key groove for sliding an Oldham-ring.

21 Claims, 13 Drawing Sheets

SCROLL COMPRESSOR WITH OILING MECHANISM

BACKGROUND OF THE INVENTION

1. Field of the Invention

The present invention relates to a scroll compressor, and more particularly relates to a mechanism to supply oil to an Oldham-ring sliding part.

2. Description of the Related Art

In a scroll compressor as a refrigerant compressor, a frame for supporting a revolving scroll has a key groove to engage with a key provided in an Oldham-ring, and revolution of the revolving scroll is performed by sliding between the key and the key groove. A conventional method of oiling to the sliding part of the Oldham-ring in the frame side is that oil in an oil reservoir provided in the bottom of the compressor is pumped to pass through an oiling hole in the main shaft, and then the oiling to the sliding part of the Oldham-ring depends only on splashing of the oil used in lubrication of the revolving shaft caused by rotation of the balancing weight fixed to the rotating main shaft. A method of more actively splashing the oil with the balancing weight is disclosed in Japanese Patent Application Laid-Open No.58-160582 (1983) where an oil reservoir is provided in the bottom of a back pressure chamber and the oil reserved in the oil reservoir is splashed by centrifugal force of an oiling path provided in the balancing weight in the form of mist. Further, a method of supplying oil not in the form of mist to the sliding part of an Oldham-key in the frame side is disclosed in Japanese Patent Application Laid-Open No.61-135994 (1986) where an oil chamber is provided in the high pressure side of a gastight enclosure and the oil reserved in the oil chamber is supplied to the sliding part of the Oldham-key utilizing the pressure difference between the high pressure side and the back pressure side.

Furthermore, a method of supplying oil the sliding part of an Oldham-key in the frame side is also disclosed in Japanese Patent Application Laid-Open No.61-135994 (1986) where an oil chamber is provided in the high pressure side of a gastight enclosure and the oil reserved in the oil chamber is supplied to the sliding part of the Oldham-key utilizing the pressure difference between the high pressure side and the back pressure side.

In the case where the oiling to the sliding part of the Oldham-ring depends on splashing by the rotating balancing weight among the conventional technologies described above, the oil supplied to the sliding part is in the form of mixed mist. Therefore, the oil attached to the inner wall of the frame above the key groove is reserved in a space formed with the outer part of the end plate of the revolving scroll, the stationary scroll and the frame, and consequently the oil acts as a resistance for the revolving motion of the revolving scroll to decrease the efficiency of the compressor and to cause lack of oil. Further, when it is stopped to supply oil from the oil reservoir in the bottom of the compressor through the oil supplying hole in the main shaft and through the rotating bearing using pressure difference or a pump, there arises a problem in that the rotating bearing and the sliding part of the Oldham-ring are not oiled.

On the other hand, in the case where the oil reserved in the high pressure side is supplied to the back pressure side utilizing the pressure difference, it is difficult to maintain an intermediate pressure in the back pressure chamber. Therefore, although oiling is smoothly performed when the pressure difference is large such as in the initial period of starting the operation of the compressor, oiling does not performed when the operation of the compressor continues long time and accordingly the pressure difference becomes small. Further, in a case where a method of supplying oil from the oil reservoir in the bottom of the compressor utilizing the pressure difference is employed as the lubricating method of the rotating bearing, there is a problem in that oil supplying from the oil reservoir in the bottom of the compressor is stopped if the pressure difference between the delivery pressure and the intermediate pressure cannot be maintained.

When the refrigerant in liquid phase enters into the back pressure chamber, the oil in the sliding part is washed by the cleaning effect of the liquid refrigerant to cause lack of lubrication. Especially, since a refrigerant coping with the earth environment (non-chloric alternative refrigerant) does not have a lubrication effect, supplying of oil is very important comparing with a case of a compressor using a conventional refrigerant.

SUMMARY OF THE INVENTION

An object of the present invention is to provide an oiling mechanism which can solve the problems described above and can concentrate the oil attached to and reserved on the inner wall of the frame to the sliding part of the Oldham-ring in the frame side in a case of oiling inside a constant pressure space, and at the same time can directly supply the oil to the sliding part in liquid phase and not in the form of mist, and further can prevent lack of oiling to the sliding part even when supplying of oil is stopped.

A further object of the present invention is to provide an oiling mechanism which can suppress heating, can prevent seizing-up, sticking and abrasion of the sliding part, and can improve the reliability in sliding capability by separating refrigerant and oil when the refrigerant mixes into the oil.

A still further object of the present invention is to provide an oiling mechanism for the sliding part which can cope with use of non-chloric refrigerant.

In order to attain the above objects, according to the present invention, oiling to a key groove can certainly performed by providing a structural portion for reserving oil and for allow the oil to flow in a position higher than the key of an Oldham-ring and the key groove (sliding part of the Oldham-ring) and by connecting the structural portion to the key groove with an oil path.

DETAILED DESCRIPTION OF THE PREFERRED EMBODIMENTS

An embodiment according to the present invention will be described in detail below, referring to FIG. 1 to FIG. 3.

Figure 1:
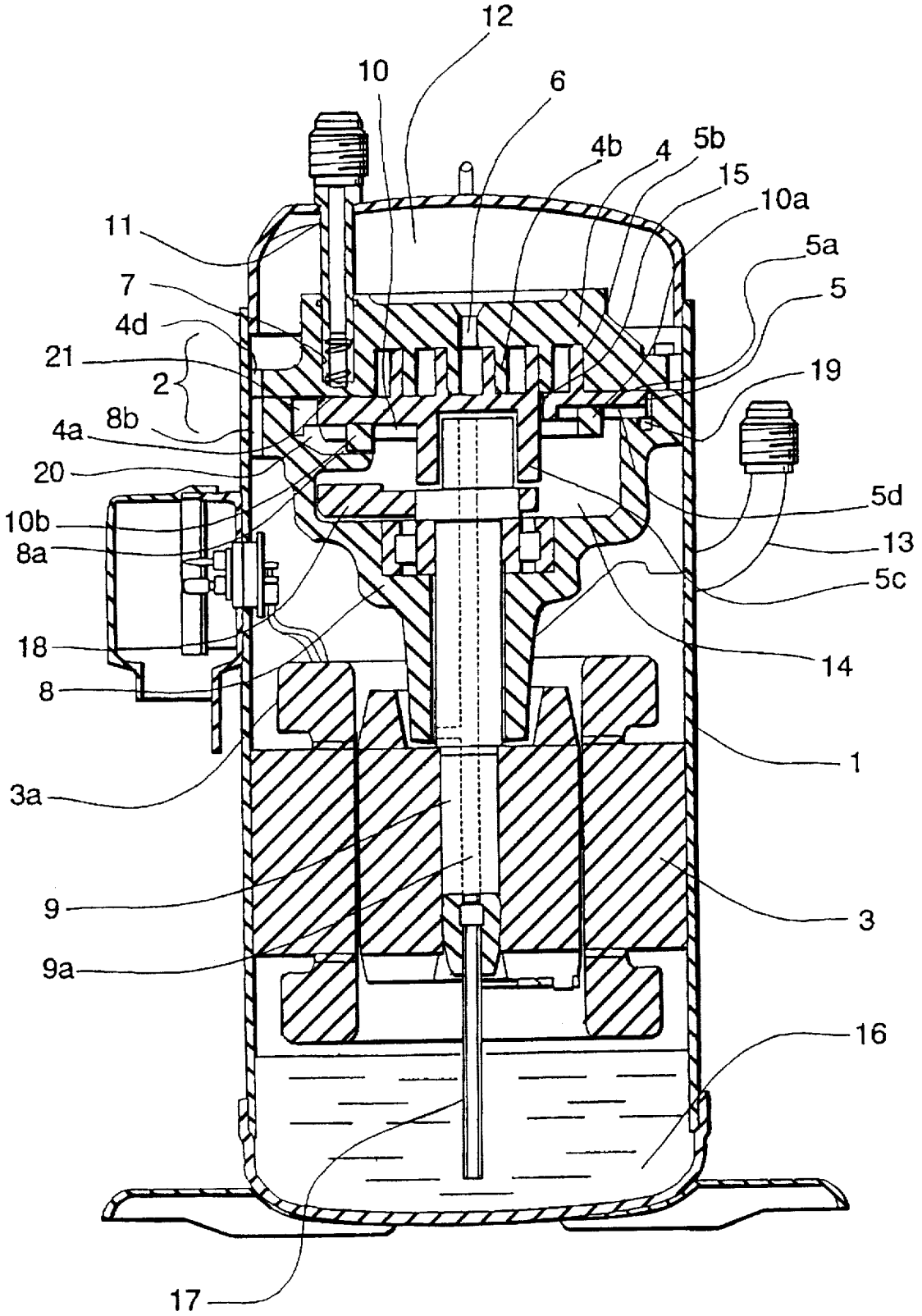
FIG. 1 is a cross-sectional view showing the whole construction of an embodiment of a scroll compressor in accordance with the present invention.
Figure 2:
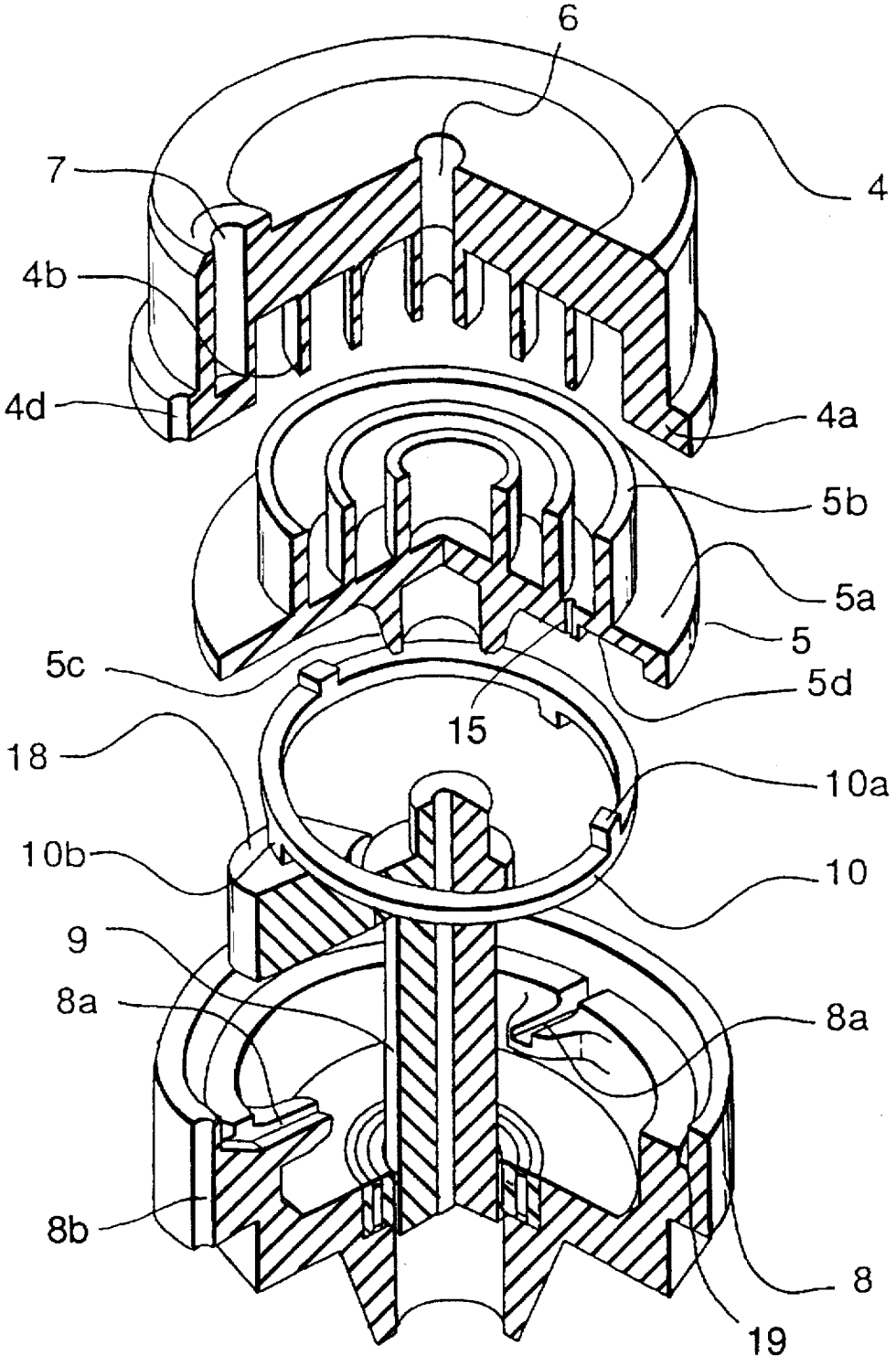
FIG. 2 is a partially cross-sectional exploded perspective view showing the connecting relationship among the main parts of the embodiment shown in FIG. 1.

FIG. 1 is a vertical cross-sectional view showing the whole construction of an embodiment of a scroll compressor in accordance with the present invention, and FIG. 2 is a partially cross-sectional exploded view showing the connecting relationship among the main parts of the embodiment of the scroll compressor. FIG. 1 is a vertical cross-sectional view unfolding the cross sections shown in FIG. 2, that is, the cross sections intersecting at angle of 90° to the center of a main shaft 9 seeing from the side of a suction pipe 11 in the upper portion of the compressor. Each of a vertical cross-sectional view showing an embodiment of scroll compressor to be described later shows the same unfolded cross sections.

A gastight enclosure 1 contains a motor unit 3 in the lower portion and a compressor unit 2 in the upper portion. The compressing chamber of the compressor unit 2 is formed by engaging a stationary scroll 4 and a revolving scroll 5 with each other. In this embodiment, casting iron is used as the material for the stationary scroll 4, the revolving scroll 5 and an Oldham-ring to be described later.

The stationary scroll 4 is composed of a disk-shaped end plate 4*a* and a spiral lap 4*b* formed in an involute curve or near-involute curve perpendicular to the end plate, and has a delivery port 6 in the center of the end plate to deliver the gas compressed in the compressing chamber and a suction port 7 in the periphery.

Similarly, the revolving scroll 5 is composed of a disk-shaped end plate 5*a* and a spiral lap 5*b* perpendicular to the end plate, and a boss 5*c* formed on the surface of the end plate in the reverse side of the lap surface. The frame 8 has a bearing part in its center to support the main shaft 9.

One end of the main shaft 9 is placed in the side of the motor 3 and has an oiling pipe 17 in its end portion, and the other end of the main shaft is rotatably engaged with the portion of the boss 5*c* of the revolving scroll 5. The jointing part of the boss 5*c* is formed eccentrically to the center of the shaft for jointing part of the main shaft 9 in the motor unit 3 and the bearing in the frame 8. The eccentric shaft part of the main shaft 9 engaging with the revolving scroll is inserted into the boss 5*c* of the revolving scroll 5 to perform revolving motion.

The stationary scroll 4 is fixed to the frame 8 with bolts (not shown), and the revolving scroll 5 is supported to the frame with the Oldham-ring 10 to perform revolving motion without rotation.

A suction pipe 11 is connected to the suction port 7 in the stationary scroll 4 through the gastight enclosure 1, and a delivery chamber 12 having the opening delivery port 6 is communicated to a lower chamber through paths 4*d*, 8*b* and also communicated to a delivery pipe 13 penetrating through the gastight enclosure 1.

When the revolving scroll 5 is revolved by the motor unit 3 through the eccentric shaft part provided at the top of the main shaft 9, the plural compressing chambers formed with the revolving scroll 5 and the stationary scroll 4 decrease their volumes as they move toward the center of the scroll to compress the refrigerant gas sucked from the suction pipe 11. The compressed gas is let out to the delivery chamber 12 through the delivery port 6 in the end plate 4*a* of the stationary scroll 4, and enters into the motor unit 3 through the paths 4*d*, 8*b* formed in the peripheries of the end plate 4*a* of the stationary scroll 4 and the frame 8, and then delivered from the delivery pipe 13 after cooled.

On the other hand, a space (back pressure chamber) 14 surrounded by the reverse surface of the revolving scroll 5 and the frame 8 is pressurized at a magnitude between the suction pressure and the delivery pressure. This intermediate pressure is produced by providing a small hole (back pressure hole) 15 in the end plate 5*a* of the revolving scroll 5, and by conducting the gas at a midpoint of compression inside the scroll to the space 14 through the small hole 15 to apply the gas to the reverse surface of the revolving scroll 5. With this gas pressure from the reverse surface, the revolving scroll 5 is pressed to the stationary scroll 4 to seal each of the compressing chambers and also to seal the outer peripheries of the end plates of the both scrolls.

An oil reservoir 16 provided in the bottom of the gastight enclosure 1 is under the delivery pressure, and the oil is supplied to the sliding parts such as the bearing by the pressure difference between the delivery pressure and the pressure of the back pressure chamber 14 through the oiling pipe 17 and a oiling hole 9*a*. The oil let out from the sliding parts such as the bearing passes through the back pressure chamber 14, and is splashed by a balancing weight 18 to turn to mist, and then supplied to the compressing chambers through the back pressure hole 15.

The oil supplied to the compressing chambers is discharged into the delivery chamber 12 through the delivery port 6 together with the compressed gas. The oil flows to the motor unit 3 along the gastight enclosure 1 through the paths 4*d*, 8*b* and a guide (not shown), and then the oil separated at the coil end 3*a* of the motor 3 flows into the oil reservoir 16 in the bottom. On the other hand, the gas is flows along the inner wall of the enclosure to be discharged through the delivery pipe 13.

The sliding part of the Oldham-ring forming a rotation preventing mechanism is composed of a key groove 5*d* of the revolving scroll 5 and a key 10*a* in the revolving scroll side of the Oldham-ring 10, and a key groove 8*a* of the frame and a key 10*b* in the frame side of the Oldham-ring 10, and the key groove and the key are reciprocally moved on a straight line.

Using the oil supplied to the revolving bearing part through the oiling hole 9*a* of the main shaft 9 from the oil reservoir 16 using the pressure difference, the sliding part of the Oldham-ring is oiled by splashing the oil dropped to the balancing weight 18.

The scroll compressor of this embodiment has a construction where an oil groove 19 is provided inside the back pressure chamber 14 of the frame 8 and the Oldham-key groove 8*a* in the frame side and the oil path 20 are communicated to each other to concentrate the oil to the sliding part of the Oldham-key.

Figure 3:
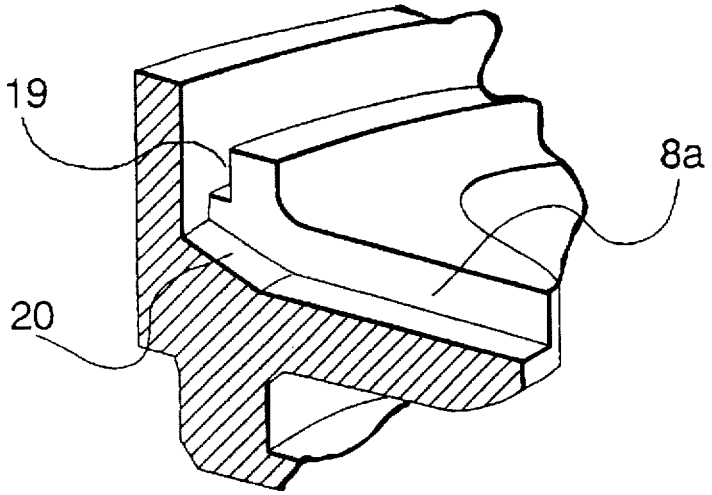
FIG. 3 is a partially enlarged cross-sectional perspective view showing a key groove in the frame side of the embodiment shown in FIG. 1.

FIG. 3 is a partially enlarged cross-sectional perspective view showing the Oldham-key groove 8*a* in the frame side shown in FIG. 1 and FIG. 2. In the space 21 formed by the outer periphery of the end plate 5*a* of the revolving scroll 5, the stationary scroll 4 and the frame 8, the oil groove 19 provided along the frame 8 and the oil path 20 connecting the oil groove 19 and the key groove 8*a* in the frame side are open grooves.

The splashed oil collides against the inner wall of the back pressure chamber 14 is splashed into the space 21 formed by the outer periphery of the end plate 5*a* of the revolving scroll 5, the stationary scroll 4 and the frame 8. The oil splashed in the space is reserved in the oil groove 19 provided along the inner surface of the frame 8. When the oil splashed in the space 21 is flows downward, the oil is collected in the Oldham-key groove 8*a* in the frame side to pass through the oil path 20 by providing the open groove of the oil path 20 communicating the Oldham-key groove 8*a* in the frame side and the oil groove 19 to each other. Therefore, the sliding part of the Oldham-key is sufficiently oiled.

Figure 4:
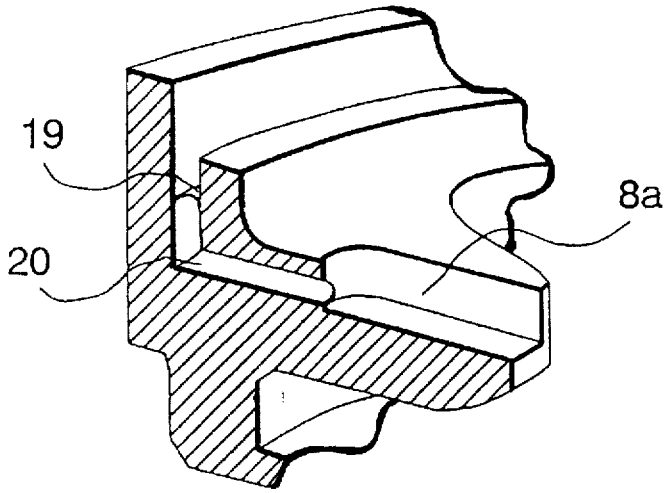
FIG. 4 is a partially enlarged cross-sectional view showing the construction of another embodiment of a key groove of the embodiment shown in FIG. 1.

FIG. 4 shows another embodiment where the construction of the oil path 20 is changed from the above embodiment. In this embodiment, the oil path 20 connecting the oil groove 19 and the key groove 8*a* in the frame side is a hole. By forming the oil path with a hole, the amount of oil supplied to the key groove 8*a* in the frame side can be controlled by changing the diameter of the hole and consequently a proper amount of oil can be supplied.

Figure 5:
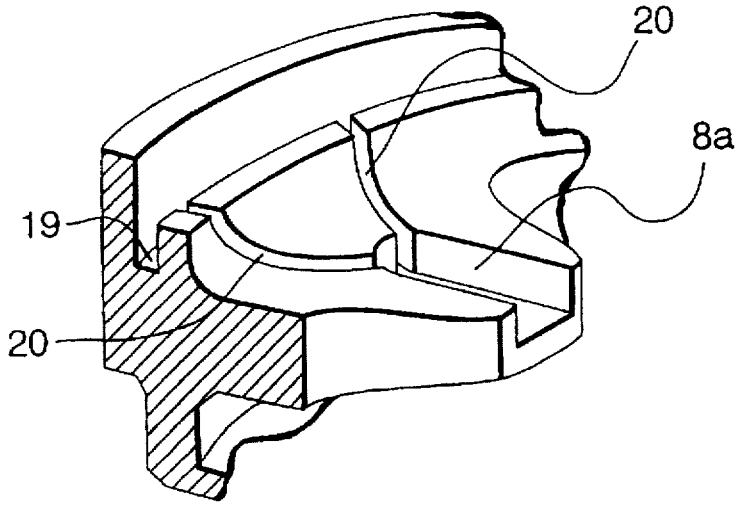
FIG. 5 is a partially enlarged cross-sectional view showing the construction of a further embodiment of a key groove of the embodiment shown in FIG. 1.

FIG. 5 shows a further embodiment where the construction of the oil path 20 is modified. The embodiment of FIG. 5 has two oil paths 20. According to the embodiment, the oil flow to the key groove can be made smooth. Although two oil paths are provided in the embodiment, it is no need to say that the number of the oil paths may be further increased if necessary.

By forming the shape of bottom surface of the oil groove in such that the junction part with the oil path is inclined lower, the oil collected to the oil groove can easily flow and accordingly can be smoothly supplied to the key groove.

The construction of providing a plurality of oil paths and the construction of inclining the shape of bottom surface of the oil groove described in this embodiment are not limited to this embodiment, but it is effective to make the oil flow smooth by combining the structures with embodiments to be described later.

Another embodiment according to the present invention will be described below, referring to FIG. 6 to FIG. 8.

Figure 6:
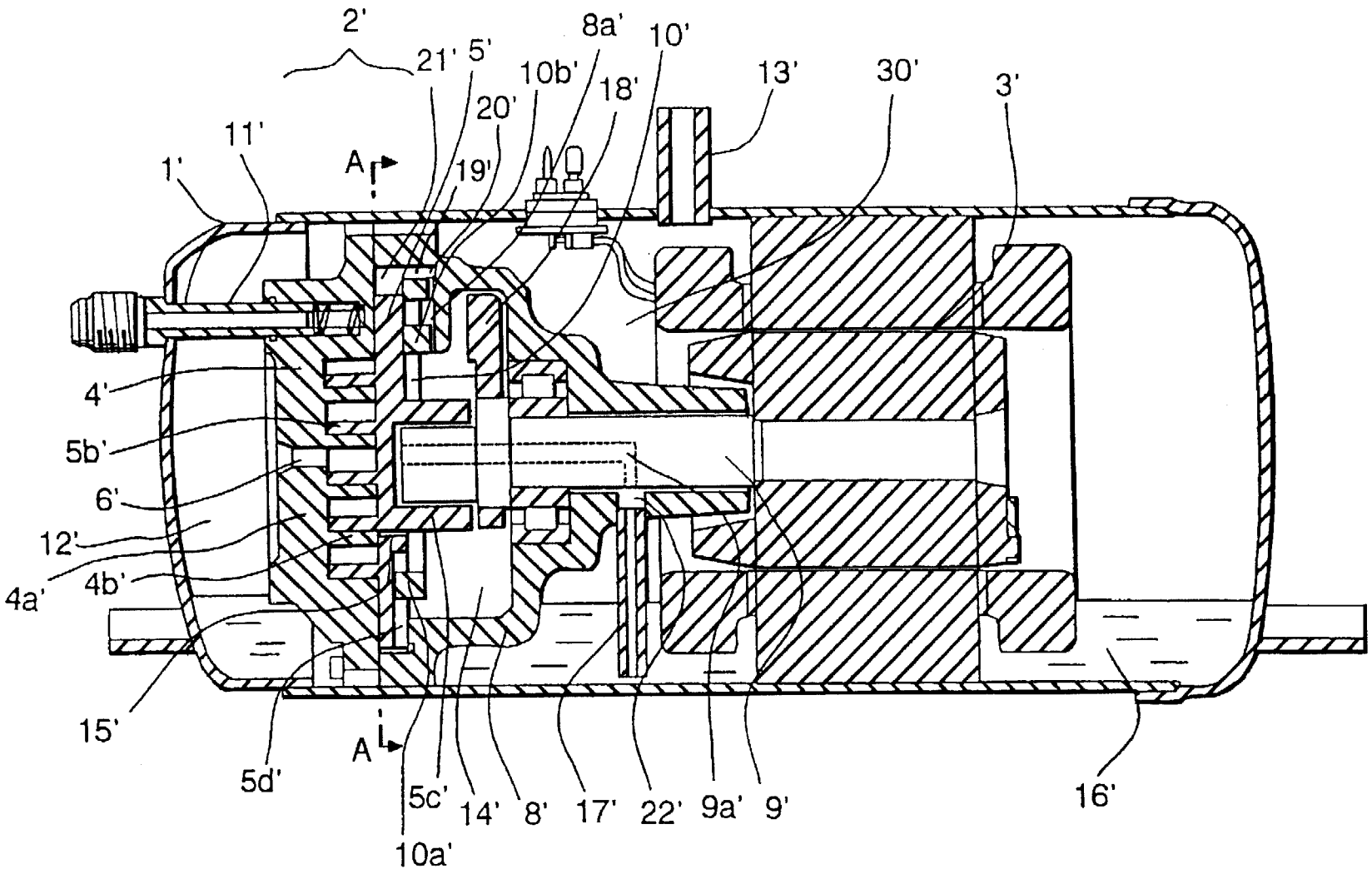
FIG. 6 is a cross-sectional view showing the whole construction of another embodiment of a scroll compressor in accordance with the present invention.

FIG. 6 is a cross-sectional view showing the whole construction of another embodiment of a horizontal type scroll compressor in accordance with the present invention similar to FIG. 1 in the aforementioned embodiment. Similar to FIG. 1 for the aforementioned embodiment, FIG. 6 is a vertical cross-sectional view unfolding the cross sections intersecting at angle of 90° to the center of a main shaft 9' seeing from the side of a suction pipe 11' in the upper portion of the compressor.

A scroll compressor unit 2' and a motor unit 3' are horizontally arranged and contained in a gastight enclosure 1'.

The scroll compressing unit 2' is composed of a revolving scroll 5' having a spiral lap perpendicular to the end plate, a stationary scroll 4' similarly having a spiral lap perpendicular to the end plate and a frame 8' integrated with the stationary scroll 4' and fixed to the gastight enclosure 1' and supporting the revolving scroll 5'. The lap 5' of the revolving scroll 5' and the lap 4*b'* of the stationary scroll 4' are engaged to each other.

An Oldham-ring 10' is provided between the revolving scroll 5' and the frame 8' to prevent rotation of the revolving scroll 5'. The motor unit 3' revolves the revolving scroll 5' through a main shaft 9', an eccentric shaft in the top end of the main shaft and a bearing boss part 5*c'* of the revolving scroll 5' engaged with the eccentric shaft through a bearing.

In the lower portion of the frame 8', there is provided an oiling pipe 17' of which the lower end has an opening to an oil reservoir 16' in the lower portion of the compressor and the upper end communicates to an oil reservoir 22' provided under the bearing part for the main shaft in the frame. Inside the main shaft 9', there is provided an oiling hole 9*a'* of which one end is opened to the oil reservoir 22' and the other end is opened to the inside of the bearing boss 5*c'* of the revolving scroll 5'.

The gas flow utilizing compressing effect and the operation of the Oldham-ring 10' are the same as in the embodiment described above.

After using the oil supplied to the revolving bearing part through the oiling hole 9*a'* of the main shaft 9' by using the pressure difference, the sliding part of the Oldham-ring is oiled by mixing and splashing the oil dropped to the bottom of the back pressure chamber 14' using the balancing weight 18'.

The horizontal type scroll compressor of this embodiment has a construction where an oil groove 19' is provided on the inner surface of the frame 8' supporting and sliding the revolving scroll 5' inside the space 21' formed by the end plate 5a' of the revolving scroll 5', the stationary scroll 4' and the frame 8' and in position higher than the key groove in the frame side, and the oil groove and the key groove in the frame side are communicated to each other to concentrate the oil to the sliding part of the Oldham-key.

That is, the splashed oil collides against the inner wall of the back pressure chamber 14' is splashed into the space 21' formed by the end plate 5a' of the revolving scroll, the outer periphery of the stationary scroll 4' and the frame 8'. The splashed oil is reserved in the oil groove 19' provided on the inner surface of the frame 8' supporting and sliding the revolving scroll 5' and in a position higher than the Oldham-key groove in the frame side. By providing the oil path 20' communicating the key groove 8a' in the frame side and the oil groove 19' to each other, when the oil splashed in the space 21' and attached to the inner wall higher than the key groove in the frame side flows downward, the oil is collected in the key groove in the frame side. Therefore, the sliding part of the Oldham-key is sufficiently oiled.

According to the embodiment, supplying of lubricating oil to the Oldham-ring 10' can be certainly performed even when the scroll compressor is of a horizontal type.

Figure 7:
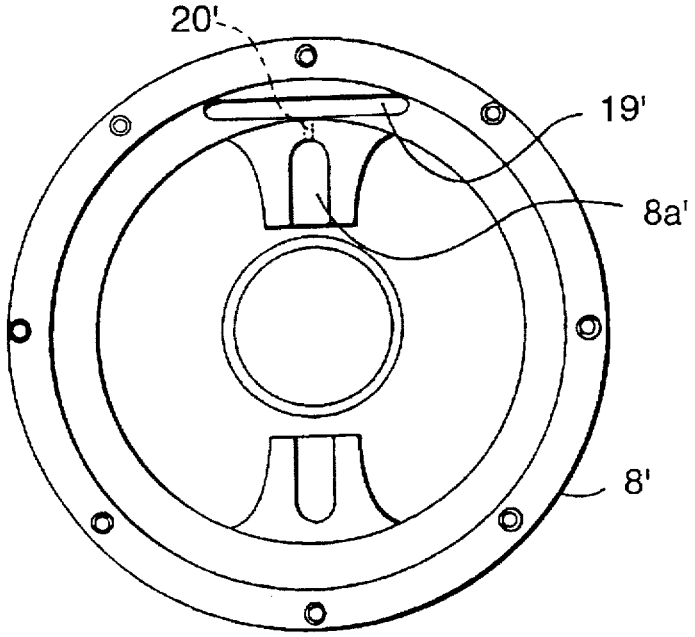
FIG. 7 is a plan view showing a frame horizontally having a key groove seeing the cross-section A—A from the arrow direction of FIG. 6.

FIG. 7 is a view of a frame 8' seeing the cross-section A—A from the arrow direction in FIG. 6, and shows an embodiment where the Oldham-key groove 8' in the frame side is arranged in the vertical direction. In this embodiment, the oil groove 19' is provided on the inner surface of the frame 8' supporting and sliding the revolving scroll 5' in the space 21' formed by the end plate 5a' of the revolving scroll, the outer periphery of the stationary scroll 4' and the frame 8' and in position higher than the Oldham-key groove in the frame side, and the oil path 20' connecting the oil groove and the key groove in the frame side is a hole. With employing the hole as the oil path, oiling to the key groove in the frame side can be ensured by suppressing running-off of oil which takes place if the oil path is open.

Figure 8:
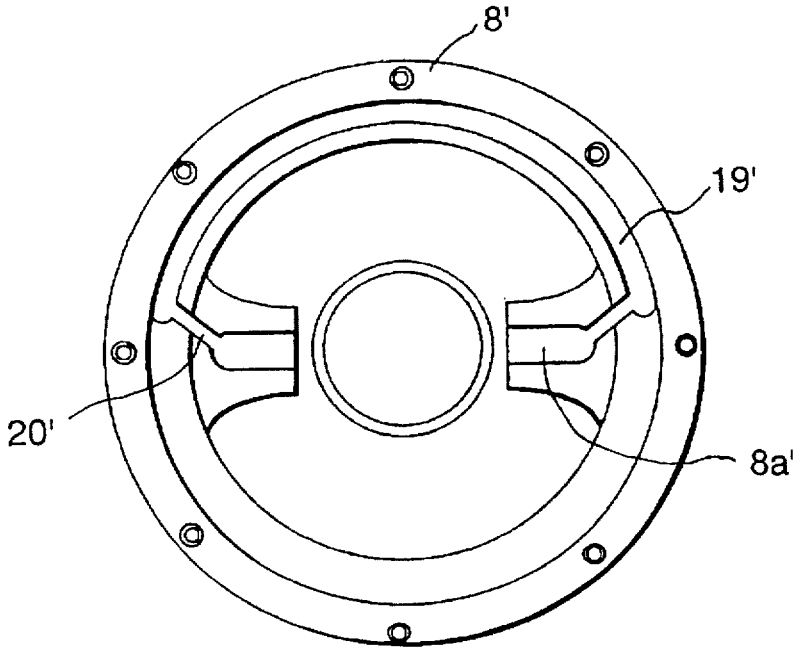
FIG. 8 is a plan view showing another construction of a frame vertically having a key groove seeing the cross-section A—A from the arrow direction of FIG. 6.

FIG. 8 is a front view of a frame 8' horizontally having the Oldham-key 8a' in the frame side which is rotated by angle of 90° from that of FIG. 7. In this embodiment, the oil groove 19' is provided along the inner periphery of the frame 8' in the space 21' formed by the end plate 5a' of the revolving scroll, the outer periphery of the stationary scroll 4' and the frame 8' and in a position higher than the key groove in the frame side, and the oil path 20' connecting the oil groove and the key groove in the frame side is an open groove. When the oil splashed in the space and attached to the inner wall higher than the key groove in the frame side flows downward, the oil is collected in the key groove in the frame side through the open groove to be oiled to the sliding part of the Oldham-key. Since the cross-sectional area of the oil groove 19' in this embodiment is larger than that of the embodiment of FIG. 7, more oil can be supplied.

In the embodiments shown in FIG. 7 and FIG. 8, it is possible to easily collect the oil by forming the outer peripheral surface of the key groove 8a' in such that the surface is inclined or curved downward as approaching to the bottom of the groove.

Another embodiment according to the present invention will be described below, referring to FIG. 9 to FIG. 11.

Figure 9:
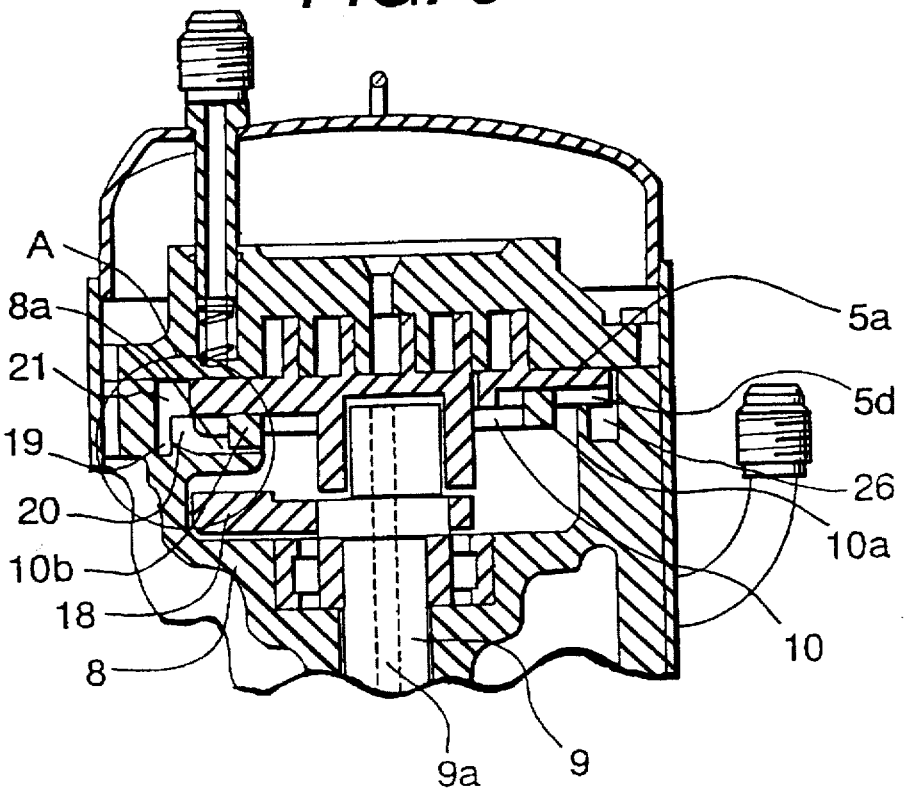
FIG. 9 is a cross-sectional view showing the compressing part of another embodiment of a scroll compressor according to the present invention.

The scroll compressor of FIG. 9 is the same type as that described in FIG. 1 and shows only a part of compressor unit 2 in FIG. 1. The indicated part of the cross section is the same as the part described in FIG. 1. The sliding part of the Oldham-ring is composed of a key groove 5d of a revolving scroll, a key 10a in the revolving scroll side of the Oldham-ring 10, a key groove 8a of the frame 8 and a key 10b in the frame side of the Oldham-ring 10, and the key groove and the key are performed reciprocal motion in a straight line.

The splashed oil collides against the inner wall of the back pressure chamber 14 is splashed into the space 21 formed by the outer periphery of the end plate 5a of the revolving scroll 5, the stationary scroll 4 and the frame 8. Then, the oil splashed in the space is reserved in an oil reservoir 26 provided in the revolving scroll side of the frame 8. When the oil splashed in the space 21 is flows downward, the oil is collected in and passed through the Oldham-key groove 8a in the frame side by providing an oil path 19 provided so as to connect to the oil reservoir 26 along the inner periphery of the frame 8 and an open groove of the oil path 20 communicating the Oldham-key groove 8a in the frame side and the oil groove 19 to each other. FIG. 10 is an enlarged cross-sectional perspective view of the part A in FIG. 9.

The oil reservoir 26 in this embodiment can reserve an amount of oil more than 10 cc and the flow rate of oil flowing out of the oil groove 19 is regulated by the width of the oil path 20. Although the number and the width of the oil paths 20 are properly determined depending on the viscosity of the oil used, the flow rate of the oil from the oil reservoir is preferably 1 cc/minute. Further, since the Oldham-ring key 10b acts as a weir, oil can be always reserved in the oil reservoir 26 and the oil groove 19. Therewith, even if supplying of oil from the oil reservoir in the bottom of the compressor due to lack of pressure difference between the intermediate pressure in the back pressure chamber and the delivery pressure in the oil reservoir in the bottom of the compressor, it is possible to supply oil to the Oldham-key groove in the frame side for a period until the pressure difference recovers to the normal state by consuming the oil reserved in the oil reservoir 26 and the oil groove 19.

Further, in a case where the refrigerant in liquid phase is mixed in the back pressure chamber, when the refrigerant in liquid phase spattered in the space 21 formed by the outer periphery of the end plate 5a of the revolving scroll, the stationary scroll 5 and the frame is reserved in the oil groove 19 and the oil reservoir 26, the liquid refrigerant having a larger density than the oil is separated from the oil and collected in the lower portions of the oil groove 19 and the oil reservoir 26. Therefore, the liquid refrigerant does not flow to the key groove 8a in the frame side and only the oil is supplied to the key groove in the frame side since the oil path 20 to the key groove 8a in the frame side is placed in a position higher than the bottom of the oil groove 19. Therewith, the oil in the sliding part of the key groove in the frame side can be prevented from washing out. On the other hand, the liquid refrigerant collected in the lower portions of the oil groove 19 and the oil reservoir 26 is not accumulated for a long time since the liquid refrigerant is evaporated under the temperature and pressure condition of the back pressure chamber.

According to this embodiment, the reliability of the sliding part can be improved since the effect of the refrigerant on the key groove can be eliminated and the oil can be stably supplied to the sliding part.

Figure 10:
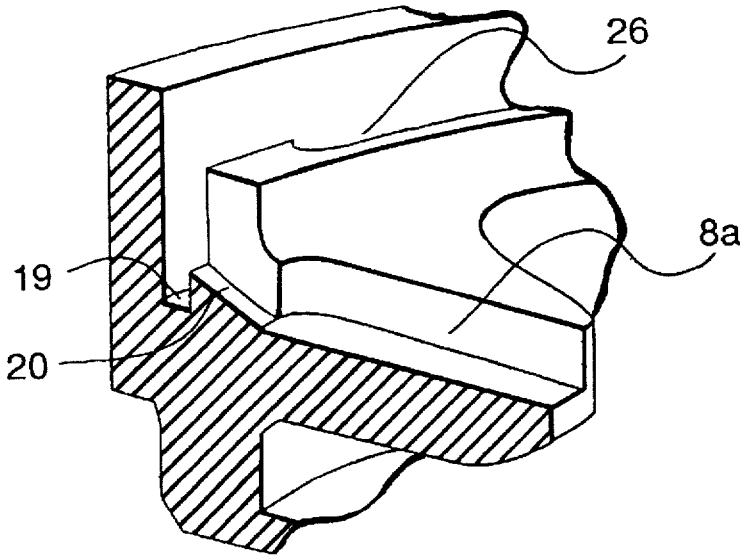
FIG. 10 is an enlarged cross-sectional perspective view of the part A of FIG. 9.
Figure 11:
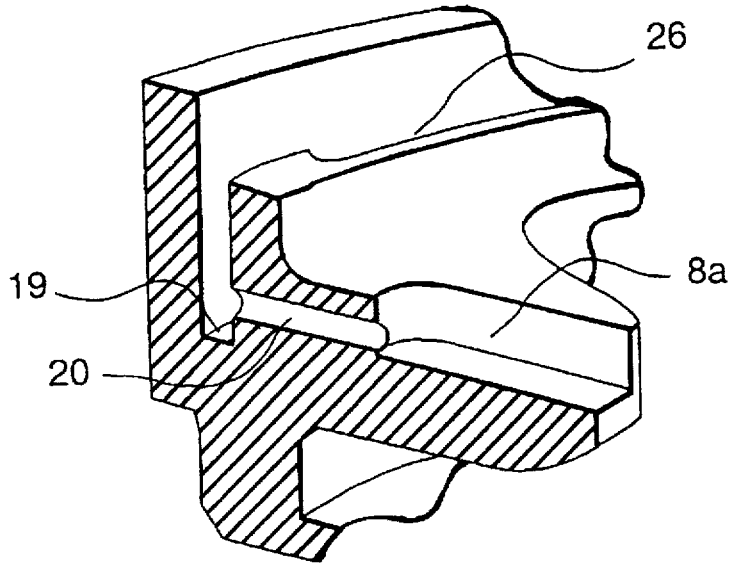
FIG. 11 is an enlarged cross-sectional perspective view showing the construction of a key groove, an oil groove and an oil reservoir of a frame alternative to the frame of FIG. 10.

The oil path 20 connecting the oil groove 19 to the key groove 8a in the frame side my be formed in a hole as shown in FIG. 11 instead of the open groove shown in FIG. 10. By forming the oil path with a hole, the flow rate of oil to the key groove 8a in the frame side can be controlled by changing the diameter of the hole and consequently a constant flow rate of oil can be supplied independently of the quantity of accumulated oil in the oil reservoir 26.

A further embodiment according to the present invention will be described bellow, referring to FIG. 12 and FIG. 13.

Figure 12:
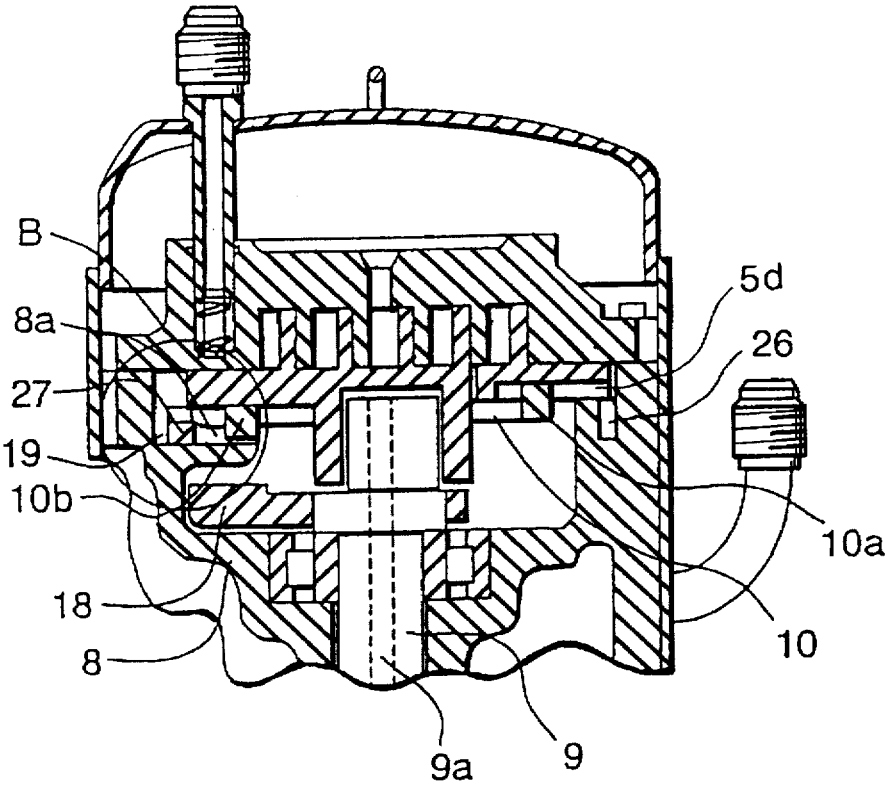
FIG. 12 is a cross-sectional view showing the compressing part of a further embodiment of a scroll compressor according to the present invention.
Figure 13:
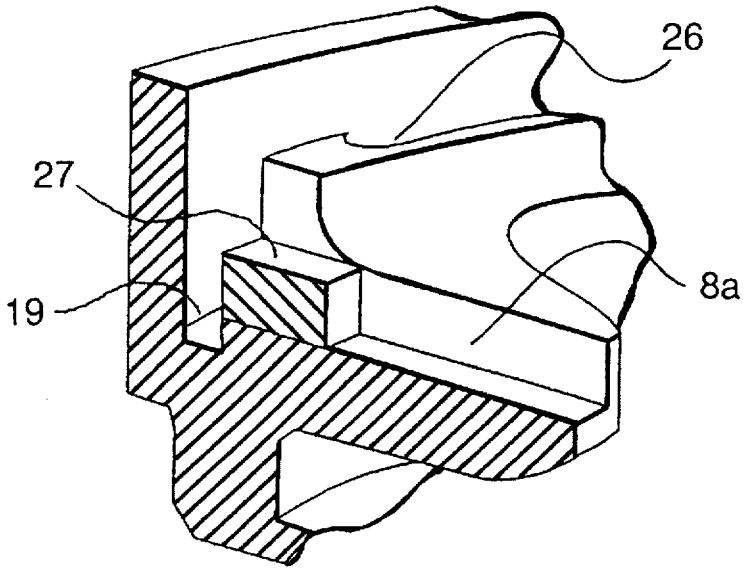
FIG. 13 is an enlarged cross-sectional perspective view of the part B of FIG. 12.

The different points of the construction shown in FIG. 12 and FIG. 13 from that of FIG. 9 and FIG. 10 described above are in that the shape of the oil path 20 is different and a filter 27 is provided in the oil path. The oil path 20 is flattened by eliminating the inclining part from the oil groove to the key groove formed in the above embodiment, and the filter 27 is placed at this position so that oil is always reserved in the oil reservoir 26 and the oil groove 19 since the filter 27 acts as a weir. A porous material such as a porous metal is used as the filter to separate refrigerant from the oil when the refrigerant is mixed into the oil. Since the viscosity of oil is larger than that of refrigerant, only the refrigerant can be evaporated by being absorbed in the filter and the oil is not absorbed in the filter but can flow around the filter. It is possible to separate the refrigerant from the oil and to supply only the oil to the sliding part of the Oldham-ring in the frame side by employing a porous material having a size of pores proper to the refrigerant and the oil used under the operating condition of the compressor.

Even when a larger amount of the liquid refrigerant is mixed in the oil, the oil in the sliding part of the Oldham-ring in the frame side cannot be washed out completely since the liquid refrigerant flow to the Oldham-key groove 8*a* in the frame side together with the oil reserved in the oil reservoir 26 and the oil groove 19. Therefore, oil can be always supplied to the sliding part of the Oldham-ring part in the frame side even if the liquid refrigerant is mixed to the oil during operation of the revolving scroll.

Figure 14:
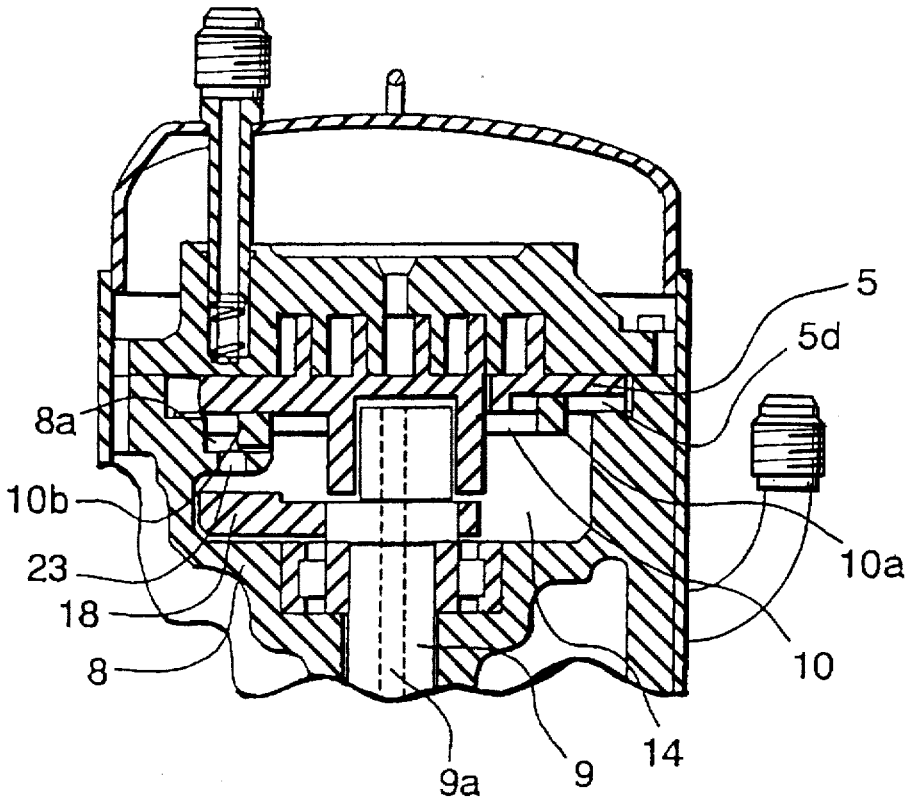
FIG. 14 is a cross-sectional view showing the compressing part of a further embodiment of a scroll compressor according to the present invention.

A still further embodiment will be described below, referring to FIG. 14. The scroll compressor of FIG. 14 is of the same type as that of FIG. 1 described above. The different point of the construction from that of FIG. 1 is in the construction of the key groove. The oil collected in the back pressure chamber after being used for the lubrication of the revolving bearing passing through the oiling hole 9*a* of the main shaft 9 is supplied to the sliding part of the Oldham-ring by splashed by the balancing weight 18. In this embodiment, a hole 23 is provided in the bottom portion of the key groove 8*a* in the frame side, that is, in the balancing weight side to directly oil to the sliding part of the key groove 8*a* in the frame side and the Oldham-key 10*b*. Therefore, the oil splashed by rotation of the balancing weight 18 is supplied to the key groove 8*a* by flowing along the inner surface of the frame 8 and the bottom Surface of the revolving scroll 5, and, at the same time, by directly flowing out through the hole 23.

Therefore, according to the embodiment, stable sliding can be performed since the oil is directly supplied and consequently the flow rate of lubricating oil becomes larger than that in a compressor without the hole.

Although an example having one hole 23 is described in FIG. 14, a plurality of holes may be provided. When plural holes are arranged in the moving direction of the key, there is an effect to supply oil over the whole groove.

Figure 15:
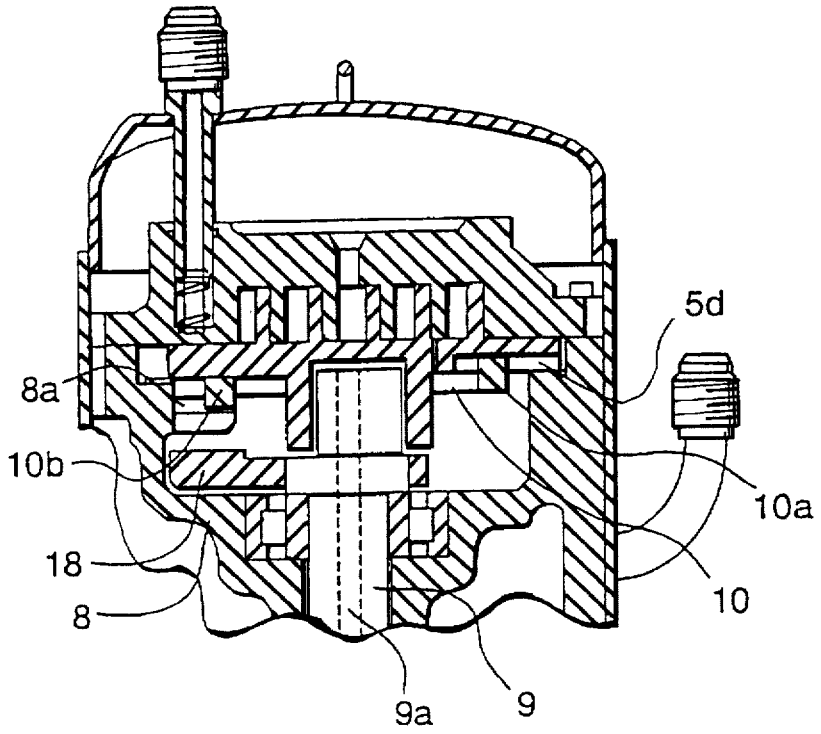
FIG. 15 is a cross-sectional view showing the compressing part of a further embodiment of a scroll compressor according to the present invention.

FIG. 15 shows a modified embodiment of the above embodiment in which the bottom portion of the key groove 8*a* is opened over the whole range of sliding. In this embodiment, oiling from the balancing weight can be easily performed, and the number of man-hour needed to machining can be decreased by performing machining of the bottom portion together with machining of the key groove 8*a* over the whole range of sliding of the key 10*b* at a time through milling machining or the like.

A further embodiment according to the present invention will be described below, referring to FIG. 16 to FIG. 18. The different point of the scroll compressor in this embodiment from those of FIG. 14 and FIG. 15 described in the above embodiments is in the construction of the balancing weight.

Figure 16:
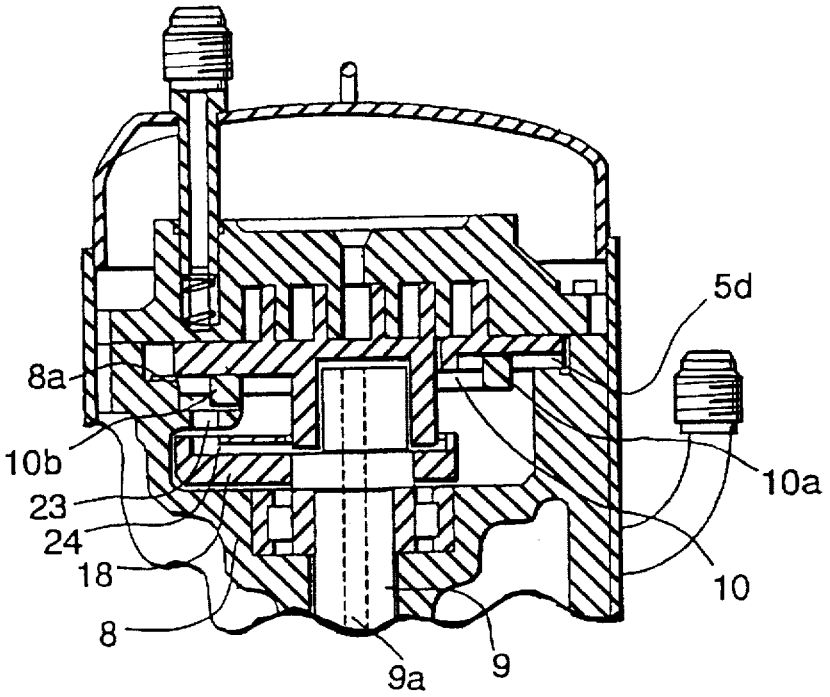
FIG. 16 is a cross-sectional view showing the compressing part of a further embodiment of a scroll compressor according to the present invention.

In the scroll compressor in this embodiment, a hole 23 similar to that in the above embodiment is provided in the bottom portion of the key groove 8*a* in the frame side as shown in FIG. 16. The balancing weight 18 in the embodiment has a tunnel-shaped oil guiding path 24 for conducting oil from its rotating center to the radial direction.

Oiling to the sliding part of the Oldham-ring in the frame side is performed by using the oil passing through the oiling hole 9*a* of the main shaft 9 by pressure difference for lubrication of revolving bearing, then collecting the oil before splashed by the balancing weight 18, splashing the oil to the key groove 8*a* in the frame side through the oil guiding path 24 formed in the balancing weight 18 with the centrifugal force produced by the rotation of the balancing weight 18 to allow the splashed oil to pass through the hole 23 in the bottom portion of the key groove 8*a* in the frame side and to reach the sliding part in order to keep a sufficient amount of oil.

It is preferable that the delivery port of oil in the side of the balancing weight 18 is provided at a position where the delivery port agrees to the hole 23 of the key groove when the balancing weight rotates and comes to the position of the key groove 8*a*.

Figure 17:
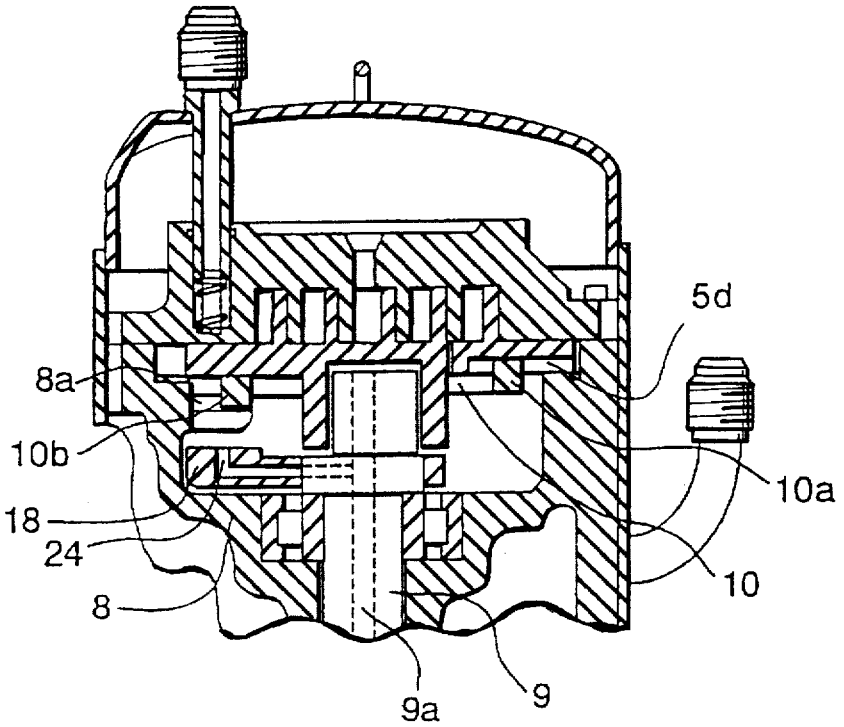
FIG. 17 is a cross-sectional view showing the compressing part of an embodiment of a scroll compressor having an alternative shape of the key groove to the construction of FIG. 16.

FIG. 17 is a cross-sectional view showing the construction of another embodiment where the bottom portion of the key groove 8*a* in the frame side is opened over the whole range of sliding part and the oil guiding path 24 formed in the balancing weight 18 is directly connected to the oiling hole 19 of the main shaft 9 comparing to the structure of FIG. 16. The flow rate of supplied lubricating oil in this construction is larger than that in the structure of FIG. 16.

Figure 18:
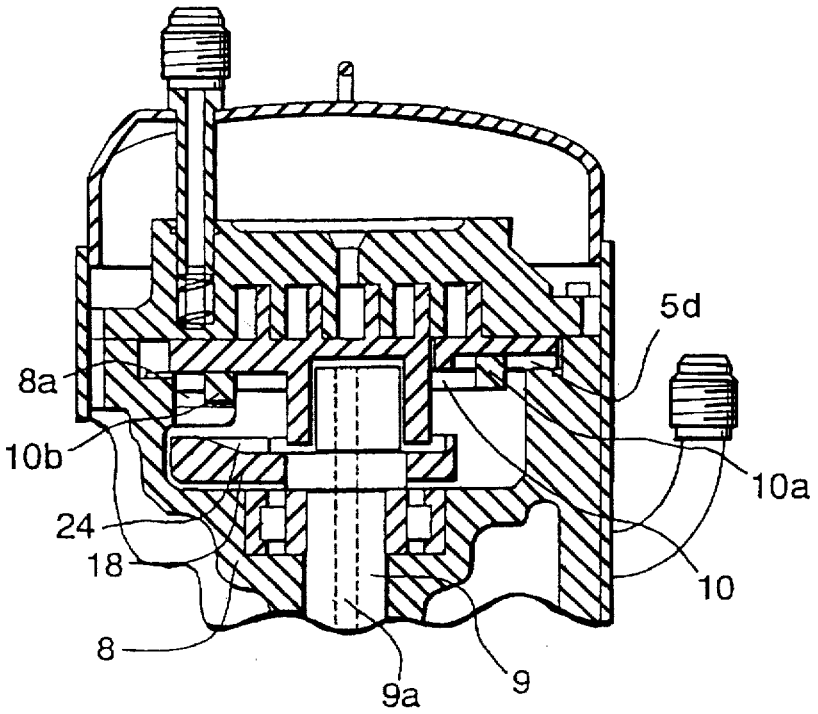
FIG. 18 is a cross-sectional view showing the compressing part of an embodiment of a scroll compressor having an alternative construction of the balancing weight to the construction of FIG. 17.

FIG. 18 shows the construction of a further embodiment where the shape of the oil guiding path 24 formed in the balancing weight 18 is modified from the construction of FIG. 17. The oil guiding path 24 is not tunnel-shaped but open to the direction of the key groove 8*a* in the frame side. By employing the oil guiding path 24 of the open groove type, manufacturing cost can be decreased through easy machining.

As described above, according to the embodiment, the flow rate of supplied oil can be increased comparing to that in the above embodiment.

Another embodiment according to the present invention will be described below, referring to FIG. 19.

Figure 19:
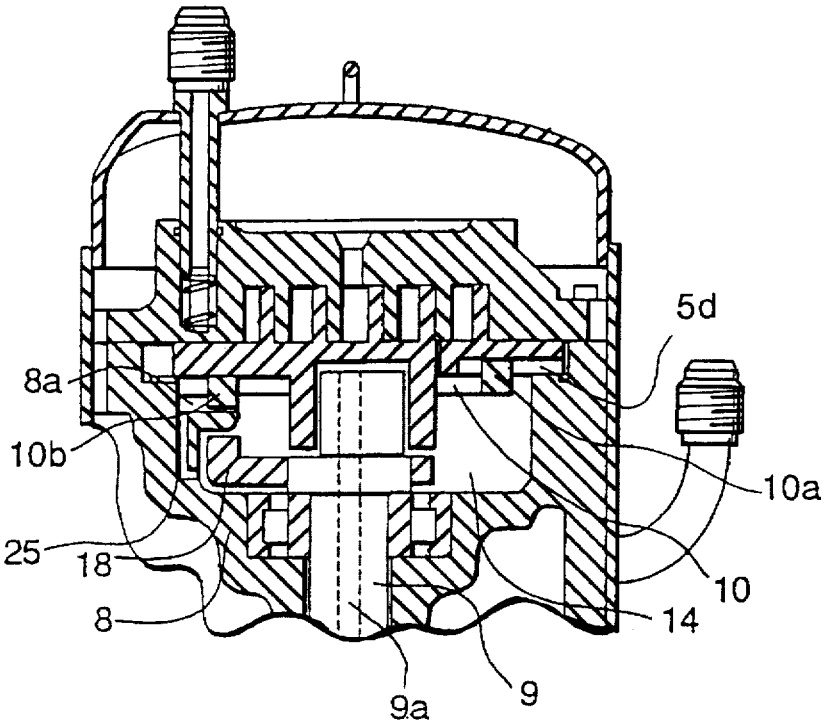
FIG. 19 is a cross-sectional view showing the compressing part of a further embodiment of a scroll compressor according to the present invention.

The scroll compressor shown in FIG. 19 is different from the above scroll compressor of FIG. 14 in the constructions of the key groove 8*a* in the frame side and the balancing weight 18. Oil is supplied out of the oiling hole 9*a* of the main shaft 9 by pressure difference, and reserved in the back pressure chamber 14 after used in lubrication of the revolving bearing. An oiling path 25 communicating from the bottom portion of the key groove 8*a* in the frame side to the gap between the balancing weight 18 and the frame 8 is provided. Oiling is performed by pumping up the oil in the gap to the key groove 8*a* in the frame side with rotation of the balancing weight 18. The balancing weight 18 is formed in such a shape that oil is easily pumped up by raising the periphery of the balancing weight and the shape is made as to nearly agree with the shape in the vicinity of the gap portion as shown in FIG. 19. With effectively removing the oil in the gap, it is possible to improve not only the lubrication effect in the sliding part of the key groove in the frame side but the efficiency of the compressor because the rotating resistance of the balancing weight 18 is decreased.

A further embodiment according to the present invention will be described below, referring to FIG. 20.

Figure 20:
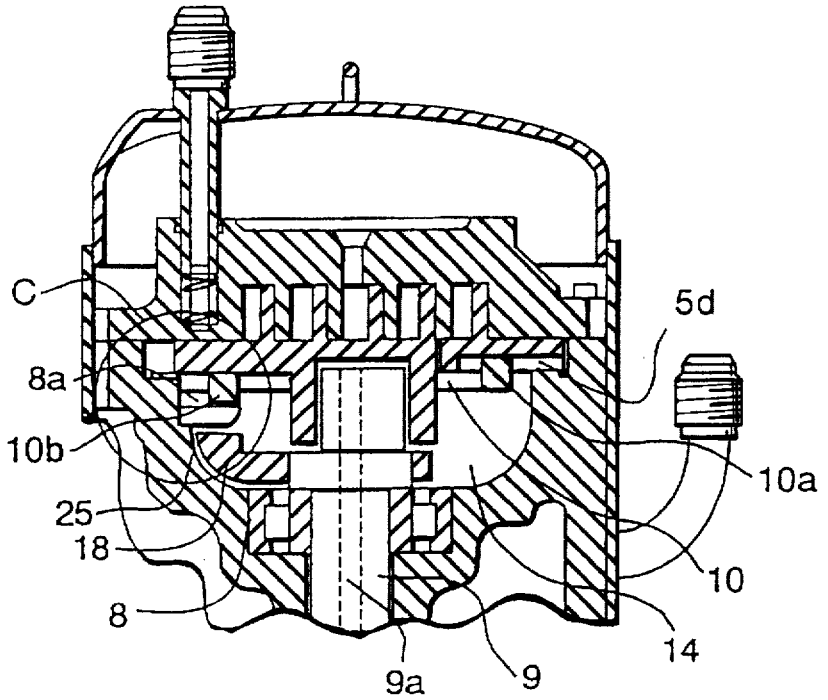
FIG. 20 is a cross-sectional view showing the compressing part of a further embodiment of a scroll compressor according to the present invention.
Figure 21:
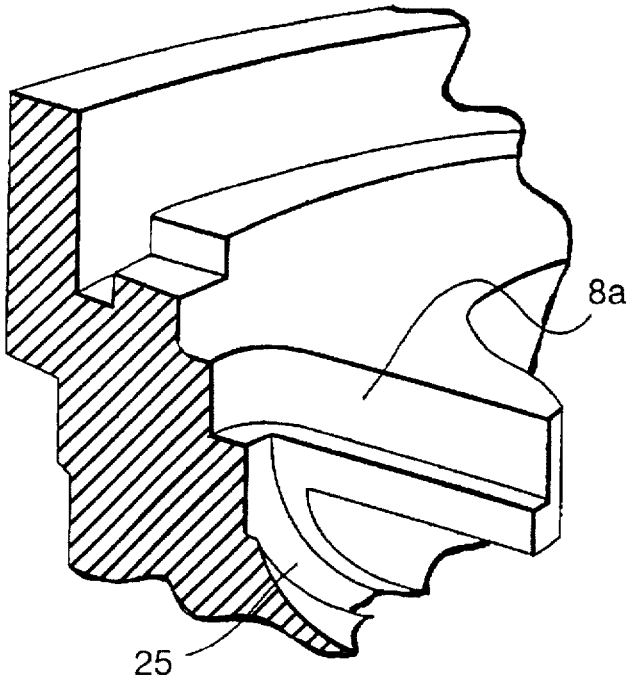
FIG. 21 is an enlarged cross-sectional perspective view of the part C of FIG. 20.

The scroll compressor shown in FIG. 20 is different from the above scroll compressor of FIG. 15 in the constructions of the frame 8 and the balancing weight 18. The bottom portion of the key groove 8*a* in the frame side is opened over the whole range of the sliding part, and the shape of the bottom portion of the back pressure chamber 14 reserving oil is formed in an arc-shape gradually approaching to the side of key groove 8*a* as departing from the center of the main shaft 9, and the bottom surface of the balancing weight 18 is formed in such a shape as to agree with the shape of the bottom portion of the back pressure chamber with a gap, and a grooving portion provided in the gap formed between the balancing weight 18 and the bottom of the back pressure chamber serves as an oiling path 25 to the key groove 8*a*. FIG. 21 is an enlarged cross-sectional perspective view of the part C shown in FIG. 20. The oil reserved in the gap is pumped up to the key groove 8*a* in the frame side by centrifugal action of the rotation of the balancing weight 18. Thereby, oiling can be performed and the lubricating effect can be improved.

The flow rate of oil to the key groove may be increased by forming a bank-shaped projection extending in the radial direction of the balancing weight and skewing toward the rotating direction of the balancing weight as going toward the outer periphery on the bottom surface of the balancing weight 18.

This embodiment is easy in machining and simple in construction comparing to the compressor having a hole inside its frame as an oiling path.

Figure 22:
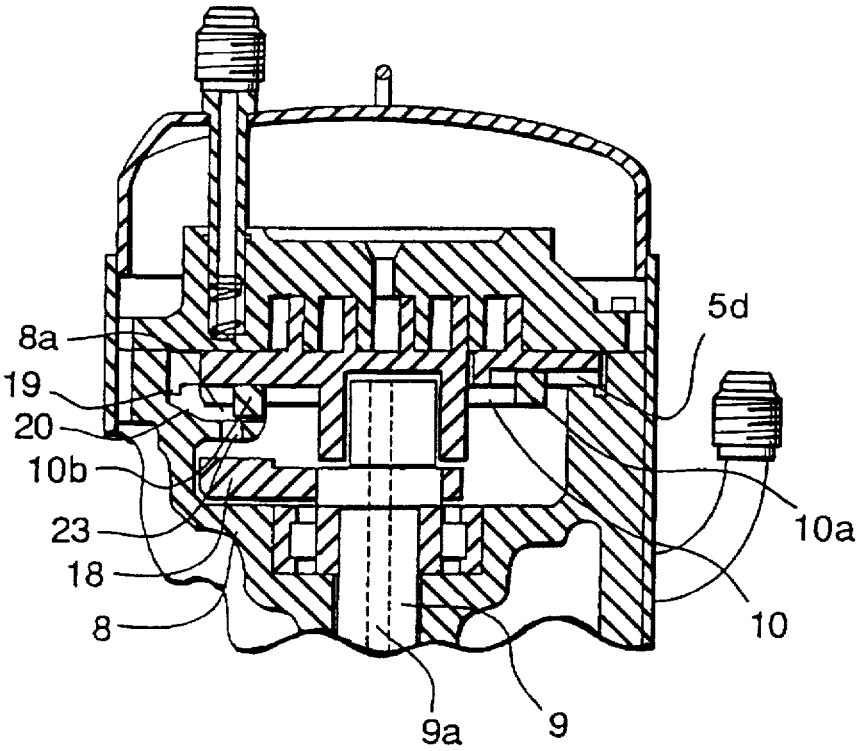
FIG. 22 is a cross-sectional view showing the compressing part of a further embodiment of a scroll compressor according to the present invention.

Further embodiments according to the present invention will be described below, referring to FIG. 22 and FIG. 23. Comparing to the embodiment of the scroll compressor shown in FIG. 1, the scroll compressor of FIG. 22 is different in that there is a hole 23 in the key groove 8*a* in the frame side. The different points of the scroll compressor of FIG. 23 from that of FIG. 22 are in that a balancing weight 18 having a guiding path 24 is employed and an oiling path 25 communicating to the gap between the balancing weight 18 and the frame is provided. Since the oiling path 25 is placed closely between the bottom of the key groove 8*a* and the end portion of the balancing weight 18, the oil pumped up through the gap is easily supplied to the bottom of the key groove 8*a*. Both of the constructions can increase the flow rate of lubricating oil comparing to the construction shown in FIG. 1.

Figure 24:
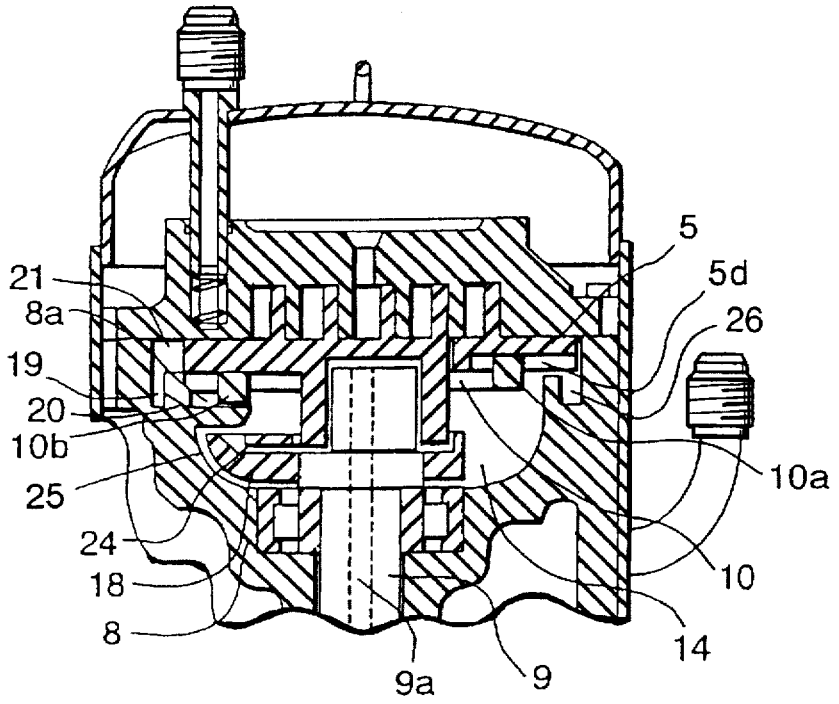
FIG. 24 is a cross-sectional view showing the compressing part of a further embodiment of a scroll compressor according to the present invention.

Another embodiment according to the present invention will be described below, referring to FIG. 24.

Figure 23:
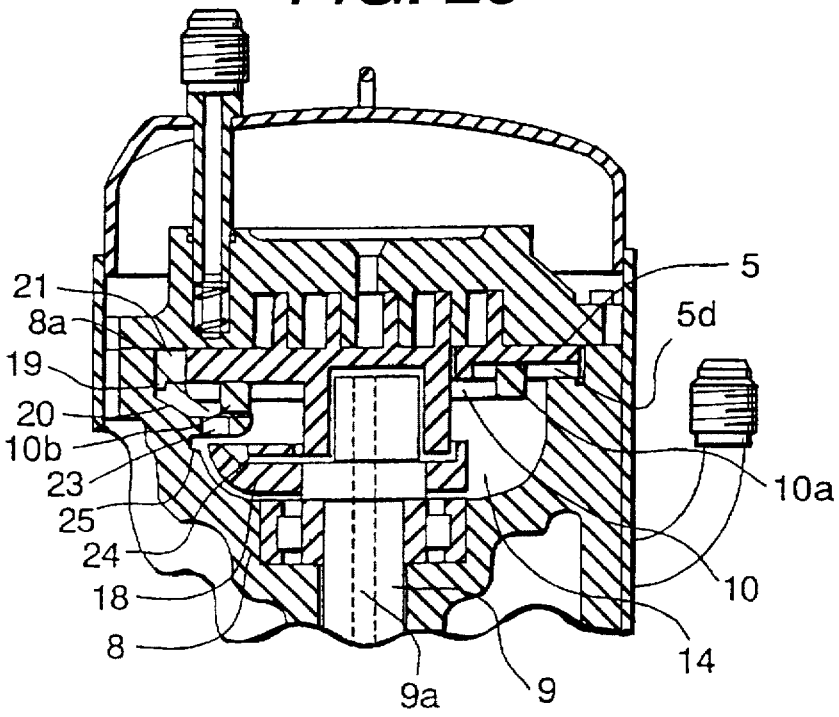
FIG. 23 is a cross-sectional view showing the compressing part of a further embodiment of a scroll compressor according to the present invention.

The different points of this embodiment from the embodiment of the scroll compressor shown in FIG. 23 are the shape of the oil groove 19 provided in the frame 8 and absence of hole in the bottom of the key groove 8*a* in the frame side.

The process of oiling to the back pressure chamber 14 is the same as in the embodiment described above.

The oil supplied to the back pressure chamber 14 is pumped up to the oil reservoir 26 along the oiling path 25 provided on the inner surface of the frame 8 communicating to the gap between the balancing weight 18 and the frame and skewing in the opposite direction to the rotating direction of the balancing weight 18 as approaching to the lower portion of the gap. Further, the oil can be concentrated to the sliding part of the Oldham-key by communicating the oil reservoir 26 and the oil groove 19 to the Oldham-key groove 8*a* in the frame side. The oil path 20 is communicated to a portion higher than the bottom of the oil groove 19.

With the construction, the oil lubricating the revolving bearing is collected, and the oil is splashed to the sliding part of the Oldham-key from the oil guiding path 24 formed in the balancing weight 18 by utilizing centrifugal force caused by rotation of the balancing weight 18, and at the same time the oil is supplied to the oil reservoir 26 and the oil groove 19. Further, the oil in the gap is pumped up to the oil reservoir 26 through the oiling path 25 communicating to the gap between the balancing weight 18 and the frame by rotation of balancing weight 18, and the oil flows from the oil reservoir 26 to the oil groove 19, and from the oil groove 19 to the oil path 20, which makes it possible to supply the oil attaching on the inner wall of the frame to the sliding part of the Oldham-key. Furthermore, the oil splashed and staying in the space 21 formed by the outer periphery of the end plate 5*a* of the revolving scroll 5, the stationary scroll 4 and the frame 8 and acting as a resistance against rotation of the revolving scroll 5 is collected in the oil reservoir 26 and the oil groove 19 provided in the inner surface of the frame 8 supporting and sliding the revolving scroll 5 in the space. By providing the oil path 20 (open groove) communicating the Oldham-key 8*a* in the frame side to the oil groove 19, when the oil splashed in the space described above falls downward, all the oil is collected in the Oldham-key groove 8*a* in the frame side. The number and the width of the oil path 20 are properly determined depending on the viscosity of the oil used. Since the flow rate of the oil from the oil groove 19 is regulated by setting the number and the width of the oil path using the viscosity of the oil and the Oldham-ring key serves as a weir, the oil reservoir 26 and the oil groove 19 can always reserve oil. Therewith, even if supplying of oil from the oil reservoir in the bottom of the compressor due to lack of pressure difference between the intermediate pressure in the back pressure chamber and the delivery pressure in the oil reservoir in the bottom of the compressor, it is possible to supply oil to the Oldham-key groove 8*a* in the frame side for a period until the pressure difference recovers to the normal state by consuming the oil reserved in the oil reservoir 26 and the oil groove 19.

In the embodiment, the oil reservoir 26 can reserve oil more than 10 cc and the flow rate of oil from the oil groove 19 is restricted by the width of the oil path 20 so that the flow rate of oil from the oil reservoir becomes to 1 cc/minute in order to cope with an operation for 5 to 10 minutes when supplying of oil from the oil reservoir in the bottom of the compressor is stopped. When refrigerant in liquid phase is mixed in the back pressure chamber 14, the liquid refrigerant is suppressed to be splashed in the form of mist by rotation of the balancing weight 18 and stayed in the oil reservoir 26 and the oil groove 19 with the oil guiding path 24 provided in the balancing weight 18 and the oiling path 25 provided in the inner wall of the frame.

In addition to this, the refrigerant splashed in the space 21 formed by the outer periphery of the end plate 5*a* of the revolving scroll 5, the stationary scroll 4 and the frame 8 is also stayed in the oil groove 19 and the oil reservoir 26. By making the bottom of the oil groove 19 and the oil reservoir 26 lower than the level of the oil path 20, the liquid refrigerant having larger density than that of oil is separated from the oil and stayed in the lower portion of the oil groove 19 and the oil reservoir 26. Since the oiling path 20 to the key groove 8*a* in the frame side is in a level higher than the bottom of the oil groove 19, the liquid refrigerant does not flow to the key groove 8*a* in the frame side and only the oil may be supplied to the key groove in the frame side. Therefore, washing-out of the oil in the sliding part of the key in the frame side can be prevented. With these constructions, the sliding part of the Oldham-key in the frame side is intensively oiled, and the oil is once reserved in the oil reservoir 26 and then oiled to the sliding part of the Oldham-key in the frame side. Therefore, even in a case where lack of oil supply from the oil reservoir in the lower portion of the compressor transiently occurs or refrigerant in liquid phase is mixed to the back pressure chamber, sufficient oil is always supplied to the sliding part of the Oldham-key in the frame side.

The present invention can be realized in the following features.

(1) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, and an Oldham-ring for preventing rotation of the revolving scroll having the key engaging with the key groove provided in the frame, which further comprises an oil reservoir for reserving oil or a channel-shaped oil groove for allowing oil to flow through its inside provided on the inner surface of the frame, and an oil path connecting the oil reservoir or the oil groove to the key groove provided in the frame to allowing the oil in the oil reservoir or the oil groove to flow to the key groove.

(2) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, and an Oldham-ring for preventing rotation of the revolving scroll having the key engaging with the key groove provided in the frame, which further comprises an oil reservoir for reserving oil provided the inside surface of the frame, a channel-shaped oil groove connected to the oil reservoir, and an oil path connecting the oil groove to the key groove provided in the frame to allowing the oil in the oil reservoir to flow to the key groove.

(3) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, and an Oldham-ring for preventing rotation of the revolving scroll having the key engaging with the key groove provided in the frame, which further comprises a downward opening in the bottom of the key groove provided in the frame, an oil reservoir for reserving oil or a channel-shaped oil groove for allowing oil to flow its inside provided on the inner surface of the oil reservoir, and an oil path connecting the oil reservoir or the oil groove to the key groove provided in the frame to allowing the oil in the oil reservoir or the oil groove to flow to the key groove.

(4) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, and an Oldham-ring for preventing rotation of the revolving scroll having the key engaging with the key groove provided in the frame, which further comprises a downward opening in the bottom of the key groove provided in said frame, an oil reservoir for reserving oil provided on the inner surface of said oil reservoir, a channel-shaped oil groove connected to the oil reservoir, and an oil path connecting the key groove provided in said frame to the oil groove to allowing the oil in the oil reservoir to flow to the key groove.

(5) A scroll compressor in the above item (1) or (3), where the oil reservoir or the oil groove is formed in a position higher than the bottom of the key groove provided in the frame.

(6) A scroll compressor in the above item (2) or (4), where the oil reservoir and the oil groove is formed in a position higher than the bottom of the key groove provided in the frame.

(7) A scroll compressor in any one of the above items (1) to (4), where the junction part in the side of the oil reservoir or the oil groove of the oil path is formed in a position higher than the bottom of the key groove.

(8). A scroll compressor in any one of the above items (1) to (7), where the oil path is an open groove.

(9) A scroll compressor in any one of the items (1) to (7), where the oil path is a hole.

(10) A scroll compressor in the above item (3) or (4), where the opening is a hole.

(11) A scroll compressor in the above item (3) or (4), where the opening provided in the key groove of the frame is provided in at least the bottom portion of the sliding range with the key.

(12) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, and an Oldham-ring for preventing rotation of the revolving scroll having the key engaging with the key groove provided in the frame, which further comprises a channel-shaped oil groove for allowing oil to flow through its inside provided on the inner surface of the frame, an oil path connecting the oil groove to the key groove provided in the frame to allow the oil in the oil groove to flow to the key groove, the bottom of said oil groove being formed at a position lower than the junction position with the oil path.

(13) A scroll compressor comprising a compressing mechanism formed by combining a revolving scroll having a spiral lap on a plate member with a stationary scroll formed a lap for engaging with the lap, a frame mounting the stationary scroll and having a space on the inside formed together with the stationary scroll, a key engaging with a key groove provided on the reverse side of the lap surface of the revolving scroll, and an Oldham-ring for preventing rotation of the revolving scroll having the key engaging with the key groove provided in the frame, which further comprises an oil reservoir for reserving oil or a channel-shaped oil groove for allowing oil to flow through its inside provided on the inner surface of the frame, an oil path connecting the oil reservoir or an oil groove to the key groove provided in the frame to allow the oil in the oil reservoir or the oil groove to flow to the key groove, and a filter provided in the oil path.

(14) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, and an Oldham-ring for preventing rotation of the revolving scroll having the key engaging with the key groove provided in the frame, which further comprises an oil reservoir for reserving oil provided on the inner surface of the frame, a channel-shaped oil groove connected to the oil reservoir, an oil path connecting the oil groove to the key groove provided in the frame to allow the oil in the oil reservoir to flow to the key groove, and a filter provided in the oil path.

(15) A scroll compressor in the above item (13) or (14), wherein the filter is formed of a porous material.

(16) A scroll compressor comprising a compressing mechanism formed by combining a revolving scroll having a spiral lap on a plate member with a stationary scroll formed a lap for engaging with said lap, an Oldham-ring for preventing rotation of the revolving scroll, a main shaft having an eccentric shaft for revolving said revolving scroll and an oiling hole for allowing lubricating oil to flow to the sliding part inside the main shaft, and a balancing weight connected to the main shaft for adjusting the imbalance of the main shaft, wherein the balancing weight comprises an oil path connected to the oiling hole of the main shaft to allow the oil supplied from the oiling hole to flow to the outer peripheral side of the balancing weight.

(17) A scroll compressor comprising a compressing mechanism formed by combining a revolving scroll having a spiral lap on a plate member with a stationary scroll formed a lap for engaging with said lap, an Oldham-ring for preventing rotation of the revolving scroll, a main shaft having an eccentric shaft for revolving said revolving scroll and an oiling hole for allowing lubricating oil to flow to the sliding part inside the main shaft, and a balancing weight connected to the main shaft for adjusting the imbalance of the main shaft, wherein the balancing weight comprises an oil path connected to the junction part with the eccentric shaft provided in the revolving scroll to allow the oil supplied from the oiling hole to flow to the outer peripheral side of the balancing weight.

(18) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, an Oldham-ring for preventing rotation of the revolving scroll having the key engaging with the key groove provided in the frame, a main shaft having an eccentric shaft for revolving said revolving scroll and an oiling hole for allowing lubricating oil to flow to the sliding part inside the main shaft, and a balancing weight connected to the main shaft for adjusting the imbalance of the main shaft, which further comprises an oil path provided in the balancing weight and connected to the oiling hole of the main shaft to allow the oil supplied from the oiling hole to flow to the outer peripheral side of the balancing weight, an oil reservoir for reserving oil provided on the inner surface of said frame, and an oil path connecting the oil reservoir to the key groove provided in the frame to allow the oil in the oil reservoir to flow to the key groove.

(19) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, an Oldham-ring for preventing rotation of the revolving scroll having the key engaging with the key groove provided in the frame, a main shaft having an eccentric shaft for revolving said revolving scroll and an oiling hole for allowing lubricating oil to flow to the sliding part inside the main shaft, and a balancing weight connected to the main shaft for adjusting the imbalance of the main shaft, which further comprises an oil path provided in the balancing weight and connected to the oiling hole of the main shaft to allow the oil supplied from the oiling hole to flow to the outer peripheral side of the balancing weight, a channel-shaped oil groove provided on the inner surface of said frame to allow oil to flow inside the oil groove, and an oil path connecting the oil groove to the key groove provided in the frame to allow the oil in the oil groove to flow to the key groove.

(20) A scroll compressor comprising a compressing mechanism formed by combining a revolving scroll having a spiral lap on a plate member with a stationary scroll formed a lap for engaging with said lap, a frame mounting the stationary scroll and having a space on the inside formed together with the stationary scroll, a key engaging with a key groove provided on the reverse side of the lap surface of the revolving scroll, an Oldham-ring for preventing rotation of the revolving scroll having the key engaging with the key groove provided in the frame, a main shaft having an eccentric shaft for revolving the revolving scroll and an oiling hole for allowing lubricating oil to flow to the sliding part inside the main shaft, and a balancing weight connected to the main shaft for adjusting the imbalance of the main shaft, which further comprises an oil path provided in the frame to supply the oil in the gap between the balancing weight and the frame to the key groove in the side of the frame using the rotating force of the balancing weight.

(21) A scroll compressor in the above item (20), wherein the oil path for oiling to key groove in the side of the frame is formed on the inner surface of the frame in a position opposite to the balancing weight and lower than the key groove in the frame side in such as to be tilted toward the direction opposite to the rotating direction of the balancing weight as going from the bottom of said key groove in the frame side to the gap.

(22) A scroll compressor comprising a compressing mechanism formed by combining a revolving scroll having a spiral lap on a plate member with a stationary scroll formed a lap for engaging with the lap, a frame mounting the stationary scroll and having a space on the inside formed together with the stationary scroll, a key engaging with a key groove provided on the reverse side of the lap surface of the revolving scroll, an Oldham-ring for preventing rotation of the revolving scroll having the key engaging with the key groove provided in the frame, a main shaft having an eccentric shaft for revolving the revolving scroll and an oiling hole for allowing lubricating oil to flow to the sliding part inside the main shaft, and a balancing weight connected to the main shaft for adjusting the imbalance of the main shaft, which further comprises an oil reservoir or a groove formed on the inner surface of the frame at a position higher than the key groove provided in the frame, an oil path connecting the key groove in the side of the frame and the oil reservoir or the groove on the inner surface of the frame, a hole provided at the bottom of the key groove in the side of the frame, an oil path provided in the balancing weight and connected to an oiling hole of the main shaft to allow the oil supplied to flow from the oiling hole to the outer peripheral side of the balancing weight, and an oil path provided in the frame to supply the oil in the gap between the balancing weight and the frame to the key groove in the side of the frame using the rotating force of the balancing weight.

(23) A scroll compressor according to any one of the above items (1) to (22), wherein the scroll compressor is a vertical type compressor having a compressing mechanism in which the revolving scroll is engaged with the stationary scroll in a horizontal plane.

(24) A scroll compressor according to any one of the above items (1) to (22), wherein the scroll compressor is a horizontal type compressor having a compressing mechanism in which the revolving scroll is engaged with the stationary scroll in a vertical plane.

(25) A scroll compressor in any one of the above items (1) to (24), wherein a non-chloric refrigerant is used as the refrigerant.

With these features, by connecting the Oldham-key groove in the frame side to the oil reservoir and/or the oil groove which are provided in the space formed by the outer periphery of the end plate of the revolving scroll, the stationary scroll and the frame and on the inner surface of the frame supporting and sliding the revolving scroll and at a position higher than the key groove in the frame side, the oil splashed in the space by the balancing weight and attached to the inner wall of the frame is reserved in the oil groove and the oil reservoir when the oil flows downward. All the reserved oil is collected to the key groove in the frame side through the oil groove and the oil path, which can increase the supplied amount of oil.

By properly selecting the width or diameter of the oil path and the number of the oil paths, the flow rate of oil to the key groove in the frame side can be controlled. Further, even when the oil supply from the oil reservoir in the bottom portion of the compressor is stopped, oiling to the sliding part of the key groove in the frame side can be continued by the Oldham-key in the frame side serving as a weir to reserve oil in the oil groove described above and supplying the oil reserved in the oil reservoir and the oil groove.

By forming the bottom surface of the oil groove in such as to make the junction part with the oil path in a lower level, the oil collected in the oil groove easily flows toward the oil path and consequently the lubricating oil can be supplied to the key groove rapidly.

Furthermore, by placing the oil reservoir side of the oil groove at a level higher than the bottom portion of the oil reservoir or by providing the filter absorbing liquid refrigerant and hardly absorbing oil such as a porous filter in the oil path, the liquid refrigerant having a density larger than the oil is separated from the oil and collected in the bottom portion of the oil reservoir. In the case of providing the filter, it is possible to prevent the liquid refrigerant from flowing to the sliding part of the key in the frame side by absorbing only the refrigerant into the filter by utilizing the difference between the viscosities of the refrigerant and the oil. Since the refrigerant reserved in the bottom portion of the oil reservoir and the filter is evaporated depending on the temperature and pressure condition inside the back pressure chamber, a sufficient amount of oil can be kept in the oil reservoir.

By providing the balancing weight with the oil guiding path communicating to the oil path for supplying oil from the oil reservoir in the bottom portion of the compressor to the bearing portion of the revolving scroll and having a diameter large enough not to increase the pressure difference for supplying oil to the bearing portion so much, and by providing the balancing weight with for collecting the oil used for lubricating the bearing portion through the inside of the main shaft and for supplying oil to the key groove in the frame side by utilizing centrifugal force of rotation of the balancing weight, the oil not in the form of mist can be directly supplied to the key groove.

By forming the oiling path communicating from the oil reservoir formed in the bottom of the key groove or on the inner surface of the frame to a position between the balancing weight and the frame in the inside or on the inner surface of the frame, the oil attached to the inner wall of the frame and collected in the gap between the balancing weight and the frame is pumped up to the key groove portion in the frame side or the oil reservoir by rotating force of the balancing weight to lubricate the sliding part of the key groove in the frame side and at the same time to effectively remove the oil inside the gap. Thereby, the rotating resistance of the balancing weight is decreased.

In addition to these, by providing an opening in the bottom of the Oldham-key groove in the frame side, oil can be easily supplied from the bottom portion of the key groove in the frame side.

The aforementioned constructions to obtain the functions described above may be employed solely or in combination. With these functions, oiling to the sliding part of the key groove in the frame side can be sufficiently performed always from the initial period of starting operation of the compressor to the period during operation of the revolving scroll even when an abnormal pressure condition transiently occurs in the back pressure chamber, or lack of supplied oil from the oil reservoir in the bottom portion of the compressor occurs due to, for example, an abnormal state of the pump, or liquid refrigerant mixes into the back pressure chamber.

The aforementioned constructions may be applied to either of a vertical type scroll compressor in which the motor is placed in the down side and the compressing mechanism is placed in the upper side or a horizontal type scroll compressor in which the motor and the compressing mechanism are horizontally placed.

As having been described above, according to the present invention, it is possible to effectively increase the flow rate of lubricating oil to the sliding part between the key of the Oldham-ring and the key groove in the frame side, and it is possible to continuously supply oil to the sliding part without stopping, and it is also possible to prevent the lubricating oil in the sliding part from washing out by liquid refrigerant when the liquid refrigerant is mixed into the oil. Thereby, lack of lubricating oil can be eliminated and heating can be suppressed, and seizing-up and sticking in the sliding part can be prevented and abrasion of the sliding part can be decreased. Therewith, the reliability of the scroll compressor can be improved.

Since the flow rate of oil to the sliding part can be increased as described above, the sufficient reliability of scroll compressor can be attained even when a non-chloric refrigerant (hydrofluorocarbon; HFC410A, HFC407C) is used as the refrigerant as well as a chloric refrigerant (hydrochlorofluorocarbon; HCFC22) is used. Further, since the flow rate of oil to the sliding part can be increased, operation of the Oldham rig can be stabilized and the nose can be decreased.

What is claimed is:

1. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove being provided on a reverse side of a lap surface of the revolving scroll, and an Oldham-ring for preventing rotation of the revolving scroll having a key engaging with the key groove provided in the frame and a key engaging the key groove provided on the revolving scroll, which further comprises:

an oil reservoir for reserving oil and for allowing oil to flow therethrough provided on an inner surface of said frame, and an oil path connecting the oil reservoir to the key groove provided in said frame to allow the oil in the oil reservoir to flow to the key groove.

2. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove provided on a reverse side of a lap surface of the revolving scroll, and an Oldham-ring for preventing rotation of the revolving scroll having a key engaging wit the key groove provided in the frame and a key engaging the key groove provided on the revolving scroll, which further comprises:

an oil reservoir for reserving oil provided on an inside surface of said frame, a channel-shaped oil groove connected to the oil reservoir, and an oil path connecting the oil groove to the key groove provided in said frame to allow the oil in the oil reservoir to flow to the key groove.

3. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove provided on a reverse side of a lap surface of the revolving scroll, and an Oldham-ring for preventing rotation of the revolving scroll having a key engaging with the key groove provided in the frame and a key engaging the key groove provided on the revolving scroll, which further comprises:

a downward opening in the bottom of the key groove provided in said frame, an oil reservoir for reserving oil and for allowing oil to flow therethrough provided on an inner surface of said frame, and an oil path connecting the oil reservoir to the key groove provided in said frame to allow the oil in the oil reservoir to flow to the key groove.

4. A scroll compressor according to any one of claim 1 and claim 3, where said oil reservoir is formed in a position higher than the bottom of the key groove provided in said frame.

5. A scroll compressor according to claim 1, where said oil reservoir and said oil groove is formed in a position higher than the bottom of the key groove provided in said frame.

6. A scroll compressor according to claim 1, where the junction part of said oil path in the side of the oil reservoir is formed in a position higher than the bottom of the key groove.

7. A scroll compressor according to claim 1, where said oil path is an open groove.

8. A scroll compressor according to claim 1, where said oil path is a hole.

9. A scroll compressor according to claim 1, where said opening is a hole.

10. A scroll compressor according to claim 3, where said opening provided in the key groove of said frame is provided in at least a bottom portion of a sliding range with the key.

11. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove provided on a reverse side of a lap surface of the revolving scroll, and an Oldham-ring for preventing rotation of the revolving scroll having a key engaging with the key groove provided in the frame and a key engaging the key groove provided on the revolving scroll, which further comprises:

a channel-shaped oil groove for allowing oil to flow therethrough provided on an inner surface of said frame, an oil path connecting the oil groove to the key groove provided in said frame to allow the oil in the oil groove to flow to the key groove, the bottom of said oil groove being formed at a position lower than the junction position with said oil path.

12. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove provided on a reverse side of a lap surface of the revolving scroll, and an Oldham-ring for preventing rotation of the revolving scroll having a key engaging with the key groove provided in the frame and a key engaging the key groove provided on the revolving scroll, which further comprises:

an oil reservoir for reserving oil and for allowing oil to flow therethrough, provided on an inner surface of said frame, an oil path connecting the oil reservoir to the key groove provided in said frame to allow the oil in the oil reservoir to flow to the key groove, and a filter provided in the oil path.

13. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove provided on a reverse side of a lap surface of the revolving scroll, and an Oldham-ring for preventing rotation of the revolving scroll having a key engaging with the key groove provided in the frame and a key engaging the key groove provided on the revolving scroll, which further comprises:

an oil reservoir for reserving oil provided on an inner surface of said frame, a channel-shaped oil groove connected to the oil reservoir, an oil path connecting the oil groove to the key groove provided in said frame to allow the oil in the oil reservoir to flow to the key groove, and a filter provided in the oil path.

14. A scroll compressor according to any one of claim 12 and 13, wherein said filter is formed of a porous material.

15. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove provided on a reverse side of a lap surface of the revolving scroll, and Oldham-ring for preventing rotation of the revolving scroll having a key engaging with the key groove provided in the frame and a key engaging the key groove provided on the revolving scroll, a main shaft having an eccentric shaft for revolving said revolving scroll and an oiling hole inside the main shaft for allowing lubricating oil to flow therethrough, and a balancing weight connected to the main shaft for adjusting the imbalance of the main shaft, which further comprises:

an oil path provided in said balancing weight and connected to the oiling hole of the main shaft to allow the oil supplied from the oiling hole to flow to the outer peripheral side of said balancing weight, an oil reservoir for reserving oil provided on an inner surface of said frame, and an oil path connecting the oil reservoir to the key groove provided in said frame to allow the oil in the oil reservoir to flow to the key groove.

16. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove provided on a reverse side of a lap surface of the revolving scroll, an Oldham-ring for preventing rotation of the revolving scroll having a key engaging with the key groove provided in the frame and a key engaging the key groove provided on the revolving scroll, a main shaft having an eccentric shaft for revolving said revolving scroll and an oiling hole inside the main shaft for allowing lubricating oil to flow therethrough, and a balancing weight connected to the main shaft for adjusting the imbalance of the main shaft, which further comprises:

an oil path provided in said balancing weight and connected to the oiling hole of the main shaft to allow the oil supplied from the oiling hole to flow to the outer peripheral side of said balancing weight, a channel-shaped oil groove provided on an inner surface of said frame to allow oil to flow inside the oil groove, and an oil path connecting the oil groove to the key groove provided in said frame to allow the oil in the oil groove to flow to the key groove.

17. A scroll compressor comprising a compressing mechanism formed by combining a revolving scroll having a spiral lap on a plate member with a stationary scroll formed with a lap for engaging with said spiral lap, a frame mounting the stationary scroll, a key groove being provided in said frame and a key groove provided on a reverse side of a lap surface of the revolving scroll, an Oldham-ring for preventing rotation of the revolving scroll having a key engaging with the key groove provided in the frame and a key engaging the key groove provided on the revolving scroll, a main shaft having an eccentric shaft for revolving said revolving scroll and an oiling hole inside the main shaft for allowing lubricating oil to flow therethrough, and a balancing weight connected to the main shaft for adjusting the imbalance of the main shaft, which further comprises:

an oil reservoir formed on an inner surface of said frame at a position higher than the key groove provided in said frame, an oil path connecting said key groove in said frame and the oil reservoir on the inner surface of the frame, a hole provided at the bottom of the key groove in said frame, an oil path provided in the balancing weight and connected to an oiling hole of the main shaft to allow the oil supplied from the oiling hole to flow to the outer peripheral side of the balancing weight, and an oil path provided in the frame to supply the oil in the gap between said balancing weight and said frame to the key groove in said frame using the rotating force of the balancing weight.

18. A scroll compressor according to any one of claims 1–3 and 11–13, wherein said scroll compressor is a vertical type compressor having a compressing mechanism in which the revolving scroll is engaged with the stationary scroll in a horizontal plane.

19. A scroll compressor according to any one of claims 1–3 and 11–13, wherein said scroll compressor is a horizontal type compressor having a compressing mechanism in which the revolving scroll is engaged with the stationary scroll in a vertical plane.

20. A scroll compressor according to any one of claims 1–3 and 11–13, wherein a non-chloric refrigerant is used as the refrigerant.

21. A scroll compressor according to claim 20, wherein a hydrofluorocarbon is used as the non-chloric refrigerant.

* * * * *